US011317662B2

(12) United States Patent
Watts

(10) Patent No.: US 11,317,662 B2
(45) Date of Patent: May 3, 2022

(54) ARTICLE OF CLOTHING HAVING ADDITIONAL COVERINGS FOR A SINGLE INDIVIDUAL

(71) Applicant: Jerome Watts, Clay, NY (US)

(72) Inventor: Jerome Watts, Clay, NY (US)

(73) Assignee: Kanga Klothing, Inc., Clay, NY (US)

( * ) Notice: Subject to any disclaimer, the term of this patent is extended or adjusted under 35 U.S.C. 154(b) by 42 days.

(21) Appl. No.: 17/100,931

(22) Filed: Nov. 22, 2020

(65) Prior Publication Data

US 2021/0068476 A1 Mar. 11, 2021

Related U.S. Application Data

(63) Continuation-in-part of application No. 16/013,641, filed on Jun. 20, 2018, now abandoned, which is a continuation-in-part of application No. 15/062,096, filed on Mar. 5, 2016, now abandoned.

(60) Provisional application No. 62/182,059, filed on Jun. 19, 2015.

(51) Int. Cl.

| | |
|---|---|
| ***A41D 13/005*** | (2006.01) |
| ***A41D 27/20*** | (2006.01) |
| ***A41D 3/00*** | (2006.01) |
| *A41B 1/00* | (2006.01) |

(52) U.S. Cl.

CPC ..... *A41D 13/0058* (2013.01); *A41D 3/005* (2013.01); *A41D 27/20* (2013.01); *A41B 1/00* (2013.01); *A41D 2200/20* (2013.01)

(58) Field of Classification Search

CPC .. A41D 27/20; A41D 27/201; A41D 13/0051; A41D 13/0058; A41D 13/0012; A41D 1/04; A41D 2200/20; A41D 2400/10

See application file for complete search history.

(56) References Cited

U.S. PATENT DOCUMENTS

| | | | | | |
|---|---|---|---|---|---|
| 2,136,879 | A | * | 11/1938 | Haber | A41D 27/10 2/270 |
| 2,226,066 | A | * | 12/1940 | Moe | A41D 27/10 2/270 |
| 2,841,794 | A | * | 7/1958 | De Grazia | A41D 27/10 2/247 |
| 2,919,443 | A | * | 1/1960 | Kashiyama | A41D 13/0012 2/94 |
| 3,077,604 | A | * | 2/1963 | Colangelo | A41D 27/20 2/93 |
| 3,193,842 | A | * | 7/1965 | Bell | A41D 27/20 2/94 |

(Continued)

*Primary Examiner* — Heather Mangine

(74) *Attorney, Agent, or Firm* — Tracy Jong Law Firm; Tracy P. Jong; Cheng Ning Jong

(57) ABSTRACT

An article of clothing adapted for use by a wearer, the article of clothing including an outer body and an inner body. The outer body includes a front sheet, a collar portion, a pair of sleeves, each sleeve extending from one side of the outer body. The inner body includes a front sheet, a collar portion, a pair of sleeves, each sleeve extending from one side of the inner body. The collar portion of the inner body is attached to the collar portion of the outer body. The inner body is disposed within the outer body. In one embodiment, a pocket is disposed on the outer surface of the front sheet of the inner body. In another embodiment, a pocket is disposed on the inner surface of the front sheet of the outer body.

13 Claims, 29 Drawing Sheets

(56) References Cited

U.S. PATENT DOCUMENTS 3,214,771 A * 11/1965 Treiber ..... A41D 19/0041 2/270
4,359,784 A * 11/1982 Harrington ..... A41D 27/10 2/158
4,791,681 A * 12/1988 Dean ..... A41D 13/012 2/102
4,882,786 A * 11/1989 Gross ..... A41D 13/0012 2/94
5,153,945 A * 10/1992 Kobayashi ..... A41D 3/04 2/172
5,165,115 A * 11/1992 Stanislaw ..... A41D 27/201 2/247
5,195,187 A * 3/1993 Yang ..... A41D 13/0012 2/102
5,302,806 A * 4/1994 Simmons ..... A41D 13/0051 219/211
5,305,471 A * 4/1994 Steele ..... A41D 13/0058 2/102
5,384,915 A 1/1995 Rodriguez
5,713,077 A * 2/1998 Humbrecht ..... A41D 13/1161 2/173
5,774,892 A * 7/1998 Tisdale ..... A41D 1/06 2/115
5,787,505 A * 8/1998 Piwko ..... A41D 13/0051 2/115
5,794,263 A * 8/1998 Carman ..... A41D 13/001 2/202
5,815,837 A * 10/1998 Christman ..... A41D 19/0041 2/158
5,953,758 A * 9/1999 Foster ..... A41D 27/10 2/268
5,970,518 A 10/1999 Jordan
6,105,170 A * 8/2000 Lisciandro ..... A41D 13/0012 2/102
6,253,381 B1 * 7/2001 Kelley ..... A41D 3/02 2/125
6,397,395 B1 * 6/2002 DeHart ..... A41D 3/005 2/173
6,564,388 B1 * 5/2003 Poston ..... A41D 15/04 2/84
6,839,911 B1 * 1/2005 Mathews ..... A41D 15/00 2/69
7,028,342 B1 * 4/2006 Nordstrom ..... A41D 1/04 2/119
7,296,302 B2 * 11/2007 DeLorenzo ..... A41D 3/005 2/202
7,519,192 B1 * 4/2009 Laycock ..... A41D 1/005 381/301
7,650,648 B2 * 1/2010 Roberts ..... A41D 13/0575 2/195.8
8,272,507 B1 * 9/2012 Crump ..... A45F 5/02 206/223
9,060,555 B1 * 6/2015 Harris ..... A41D 27/207
9,521,873 B1 * 12/2016 Mignone ..... A41D 13/1161
10,264,831 B1 * 4/2019 Hemker ..... A41D 13/1245
2003/0154536 A1 * 8/2003 Anderson ..... A41D 3/02 2/108
2004/0133967 A1 * 7/2004 West ..... A41D 27/20 2/247
2005/0015844 A1 * 1/2005 Parsons ..... A41D 3/00 2/94
2005/0223466 A1 * 10/2005 Jennings ..... A45C 1/04 2/102
2006/0253954 A1 * 11/2006 Music ..... A41D 13/0051 2/115
2007/0000030 A1 * 1/2007 Toomey ..... A41D 1/04 2/247
2007/0256206 A1 * 11/2007 Nilsen ..... A63B 21/065 2/69
2008/0047045 A1 * 2/2008 Atallah ..... A41D 15/005 2/93
2008/0196140 A1 * 8/2008 Mayerson ..... A41D 27/10 2/84
2008/0201818 A1 * 8/2008 Nilforushan ..... A61F 7/02 2/69
2009/0000002 A1 * 1/2009 Hadash ..... A41D 13/0058 2/16
2009/0031468 A1 * 2/2009 Sandoval ..... A41D 27/204 2/69
2009/0235426 A1 * 9/2009 Johnston ..... A41D 3/005 2/84
2010/0077530 A1 * 4/2010 O. ..... A41D 27/20 2/115
2010/0115684 A1 * 5/2010 Freedman ..... A41D 1/04 2/128
2010/0205720 A1 * 8/2010 Ortega Astor ..... A41D 13/1281 2/247
2011/0231982 A1 * 9/2011 Echikson ..... F41C 33/048 2/115
2011/0239346 A1 * 10/2011 Doherty ..... F41H 1/02 2/2.5
2011/0289649 A1 * 12/2011 Wong ..... A41D 1/04 2/84
2012/0005802 A1 * 1/2012 Claeys ..... A41D 27/204 2/84
2012/0060256 A1 * 3/2012 Parker ..... A41D 3/02 2/85
2012/0060261 A1 * 3/2012 Raviv ..... A41D 27/205 2/252
2012/0073031 A1 * 3/2012 Horwitz ..... A42B 1/008 2/209.13
2012/0144550 A1 6/2012 Nejad
2012/0227153 A1 * 9/2012 Laycock ..... A41D 27/10 2/88
2012/0266351 A1 * 10/2012 Kim ..... A41D 27/20 2/93
2012/0276812 A1 * 11/2012 Wollowick ..... A41C 3/0035 450/89
2012/0305541 A1 * 12/2012 Giles ..... A41D 13/0051 219/211
2013/0000010 A1 * 1/2013 Ryan ..... A41D 27/201 2/84
2013/0042383 A1 * 2/2013 Ryan ..... A41D 15/00 2/84
2013/0152269 A1 * 6/2013 Coward ..... A41D 13/08 2/84
2013/0152270 A1 * 6/2013 Neal ..... A41D 3/005 2/84
2013/0219581 A1 * 8/2013 Schrimpf ..... A41D 27/20 2/69
2014/0012161 A1 * 1/2014 Ross, Jr. ..... A41D 27/10 600/595
2014/0096305 A1 * 4/2014 Friesen ..... A41D 1/04 2/84
2014/0109287 A1 * 4/2014 Ramirez ..... A42B 1/048 2/84
2014/0283281 A1 * 9/2014 Willis ..... A41D 13/0015 2/228
2014/0338092 A1 * 11/2014 Kinsey ..... A42B 1/048 2/84
2015/0082506 A1 * 3/2015 Yee ..... A41D 27/204 2/69
2015/0181960 A1 * 7/2015 Goeglein ..... A41D 27/20 2/243.1
2015/0296909 A1 * 10/2015 Sachs ..... A41B 1/08 2/84
2016/0015104 A1 * 1/2016 Edwards ..... A41D 27/20 2/94
2016/0073716 A1 * 3/2016 Short ..... A41D 27/20 2/247
2016/0135517 A1 * 5/2016 Silverberg ..... A41D 13/005 2/93
2016/0150838 A1 * 6/2016 Lee ..... A61J 15/0053 2/113
2016/0150847 A1 * 6/2016 Johnson ..... A41D 31/18 2/84
2016/0366953 A1 * 12/2016 Watts ..... A41D 13/0058

(56) References Cited

U.S. PATENT DOCUMENTS

| | | | | |
|---|---|---|---|---|
| 2016/0374421 | A1* | 12/2016 | Washington | A42B 1/245 2/84 |
| 2017/0020215 | A1* | 1/2017 | Merritt | A41D 1/04 |
| 2017/0055612 | A1* | 3/2017 | Francis, II | A41B 13/005 |
| 2017/0119072 | A1* | 5/2017 | Coulombe | A41D 27/08 |
| 2017/0156425 | A1* | 6/2017 | Jeong | A41D 27/02 |
| 2017/0231302 | A1* | 8/2017 | Rhodes | A41D 27/20 2/69 |
| 2018/0000172 | A1* | 1/2018 | Hill | A41D 13/001 |
| 2018/0064190 | A1* | 3/2018 | Khan | A41D 1/005 |
| 2018/0116311 | A1* | 5/2018 | Callison | A41D 27/04 |
| 2018/0160744 | A1* | 6/2018 | Blauer | A41D 13/05 |
| 2018/0279703 | A1* | 10/2018 | Stratton | A41D 1/04 |
| 2018/0295912 | A1* | 10/2018 | Watts | A41D 13/0058 |
| 2018/0310648 | A1* | 11/2018 | Rhodes | A41D 27/10 |
| 2018/0333294 | A1* | 11/2018 | Forzani | A61F 7/007 |
| 2018/0343941 | A1* | 12/2018 | Arnold | A41D 3/04 |
| 2019/0098948 | A1* | 4/2019 | Studinger | A41D 27/201 |
| 2019/0117440 | A1* | 4/2019 | Trujillo | A61F 5/3746 |
| 2019/0125012 | A1* | 5/2019 | White, Jr. | A41D 27/201 |
| 2019/0208936 | A1* | 7/2019 | Thomas | A47G 9/066 |
| 2019/0289936 | A1* | 9/2019 | Hourani | A41D 13/0058 |
| 2019/0380398 | A1* | 12/2019 | Plant | A41D 27/207 |
| 2020/0008500 | A1* | 1/2020 | Speciale | A41D 27/10 |
| 2020/0029637 | A1* | 1/2020 | Boyd | A41D 27/205 |
| 2020/0146372 | A1* | 5/2020 | Kwak | A41D 27/20 |
| 2020/0345090 | A1* | 11/2020 | Zahradka | A41D 27/20 |
| 2021/0137197 | A1* | 5/2021 | Smith | A41D 3/005 |
| 2021/0267291 | A1* | 9/2021 | Mayer | A41D 27/201 |
| 2021/0329985 | A1* | 10/2021 | Arizmendi | A41D 7/008 |

* cited by examiner

ARTICLE OF CLOTHING HAVING ADDITIONAL COVERINGS FOR A SINGLE INDIVIDUAL

PRIORITY CLAIM AND RELATED APPLICATIONS

This continuation-in-part application claims the benefit of priority from non-provisional application U.S. Ser. No. 16/013,641 filed Jun. 20, 2018 which in turn claims the benefit of priority from non-provisional application U.S. Ser. No. 15/062,096 filed Mar. 5, 2016 which in turn claims the benefit of priority from the provisional application U.S.S.N. 62/182,059 filed Jun. 19, 2015. Each of said applications is incorporated by reference in its entirety.

BACKGROUND OF THE INVENTION

1. The Field of the Invention

The present invention is directed generally to an article of clothing having internally-disposed coverings. More specifically, the present invention is directed to an article of clothing having pockets disposed on one or more inner surfaces of the article of clothing and capable of accommodating extremities of its wearer.

2. Background Art

U.S. Pat. No. 5,384,915 to Rodriguez (Hereinafter Rodriguez) discloses an outer garment to be worn by one or more people together, having an outer jacket with a pair of sleeves, and an inner jacket portion with one sleeve. The outer jacket and inner jacket are partially connected at the neck opening and partially connected at the waistband. The garment is convertible from an unexpanded configuration wearable by one person to an expanded configuration wearable by at least two people. In the unexpanded configuration, the one sleeve of the inner jacket portion is inserted by the wearer into one of the sleeves of the outer jacket. To change to the expanded configuration, a securing feature on the back of the outer garment is released, allowing additional folded material to be unfolded into an expanded back portion. In addition, in another embodiment, when an inner panel is attached to the back portion of the outer jacket, two people can both be separately enveloped in their own garment. The expandable feature allows for ease of movement by the people wearing the garment. When worn by two caring people, they can enjoy close physical contact and embrace each other while wearing the garment. The garment is designed for warmth and is also adaptable to different-sized people. Rodriguez discloses an outer garment that is configured for two wearers. The internal sleeves of Rodriguez are not disposed adjacent their respective outer sleeves as they are not configured to be worn in a manner disclosed herein. Rodriguez fails to disclose an internal pocket. Rodriguez's garment is of a jacket type, i.e., it is not a continuous piece of garment that may be put on, through the body hole of the clothing, e.g., sweater, but instead having a closable front split when disposed on a wearer.

U.S. Pat. No. 5,970,518 to Jordan (Hereinafter Jordan) discloses an outfit/costume that two or more people can wear at the same time. The outfit/costume has what appears from the outside to be three or more legs and the center leg will hold a leg of each person. It also has two arm sleeves, one for each person, inner sleeves that will hold the other two inner arms of the persons and at least two neck apertures for the persons wearing the outfit/costume. Again, Jordan discloses an outfit that is configured for two wearers. The internal sleeves of Jordan are also not disposed adjacent their respective outer sleeves as they are not configured to be worn in a manner disclosed herein. Jordan also fails to disclose an internal pocket.

U.S. Pat. Pub. No. 20120144550 of Nejad (Hereinafter Nejad) discloses a poncho style blanket configured to provide its wearer warmth and support. The so-called Ponchillow allows its consumers to sleep and sit virtually anywhere with the support of its unique neck pillow and removable seat cushion, carry personal items easily and tie it altogether with the warmth of its fleece poncho style blanket construction. Ponchillow is purported to be a blanket that can be used while driving or riding in a car, flying in plane, everyday shopping, watching a movie or your child play their favorite outdoor sports. According to Nejad, blankets today do not offer the all-in-one convenience that Ponchillow offers. Consumers are forced to carry multiple items such as; blankets, neck support, head coverings, storage device and pillows for support and cushion. Ponchillow is designed to combine all these features into one compact, comfortable and portable product. However, Ponchillow does not include the same construction details as those articles of clothing, e.g., sweater, shirts, etc., which are widely used.

Thus, there is a need for an article of clothing suitable for adding warmth to its wearer while not altering the appearance of a normal article of clothing. There is also a need for an article of clothing having one or more mechanisms integrally built with the article of clothing for adding warmth to its wearer when additional warmth is desired and capable of being at least partially removed or altered when additional warmth is no longer needed.

SUMMARY OF THE INVENTION

In accordance with the present invention, there is provided an article of clothing adapted for use by a wearer having a torso having a front side, the article of clothing including:

(a) a body configured for covering the torso, said body including a single front sheet configured for covering the front side of the torso of the wearer, said single front sheet having an innermost surface and a first pocket disposed on said innermost surface of the single front sheet, wherein the first pocket includes two openings, each opening adapted for access with one hand of the wearer;

(b) at least one opening disposed on a side of the body and the article of clothing further includes at least one sleeve having a top end, a bottom end, an inside surface and an outside surface, the at least one sleeve is attached at the top end to the at least one opening of the body and the at least one sleeve includes a second pocket disposed on the bottom end of the inside surface of the at least one sleeve, the second pocket having an opening for alternatively accommodating one of the wearer's hands;

(c) a neck opening disposed on a top portion of the body and a hood extending from the neck opening, the hood including a pair of third pockets, each of the pair of third pockets of the hood is configured for receiving a heat pack and each of the pair of third pockets is disposed at a location such that when disposed over the wearer, the each of the pair of third pockets is disposed substantially over an ear of the wearer; and (d) a pair of fourth pockets, a first of the pair of fourth pockets is disposed on the bottom end on the outside surface of one of the at least one sleeve with an unclosable opening of the first of the pair of fourth pockets disposed on a bottom edge of the at least one sleeve and a second of the pair of fourth pockets is disposed on the bottom end on the inside surface of the other one of the at least one sleeve with an unclosable opening of the second of the pair of fourth pockets disposed on a bottom edge of the other one of the at least one sleeve.

In one embodiment, the article of clothing is a sweater. In one embodiment, the second pocket further includes an internal pocket attached to a portion of an interior surface of the second pocket, the internal pocket including an opening configured for receiving a heat pack. In one embodiment, the at least one of the two openings of the first pocket includes a zipper configured for controlling access through the at least one opening of the first pocket. In one embodiment, the at least one opening of the second pocket includes a complementary hook and loop system configured for controlling access through the at least one opening of the second pocket. In one embodiment, the article of clothing further includes a ceiling pocket configured for holding a heat pack, the ceiling pocket is disposed on a surface of a ceiling of the hood. In one embodiment, the article of clothing further includes a cuff extending from one of the bottom edge of the at least one sleeve and the bottom edge of the other one of the at least one sleeve.

An object of the present invention is to provide an article of clothing that includes additional sleeves or coverings for a wearer's upper extremities including such areas as the arms, hands, head and torso.

Another object of the present invention is to provide an article of clothing that includes additional sleeves or internally or inconspicuously disposed additional coverings or pockets for a wearer's arms and hands that are integrally built with the article of clothing.

Another object of the present invention is to provide an article of clothing that includes additional coverings for a wearer's hands where the additional coverings are capable to be used without restricting movement of the wearer's arms.

Another object of the present invention is to provide an article of clothing that includes additional coverings capable of removably receiving heat packs to add warmth to the ears, head, hands and torso of a wearer.

Another object of the present invention is to provide an article of clothing that includes additional sleeves or coverings for a wearer's arms, hands, torso, ears and head that are concealable.

Another object of the present invention is to provide an article of clothing that includes additional sleeves or coverings for a wearer's arms, hands, torso, ears and head where the additional sleeves or coverings blend into normal and ubiquitous clothing.

Whereas there may be many embodiments of the present invention, each embodiment may meet one or more of the foregoing recited objects in any combination. It is not intended that each embodiment will necessarily meet each objective. Thus, having broadly outlined the more important features of the present invention in order that the detailed description thereof may be better understood, and that the present contribution to the art may be better appreciated, there are, of course, additional features of the present invention that will be described herein and will form a part of the subject matter of this specification.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

PARTS LIST

Figure 1:
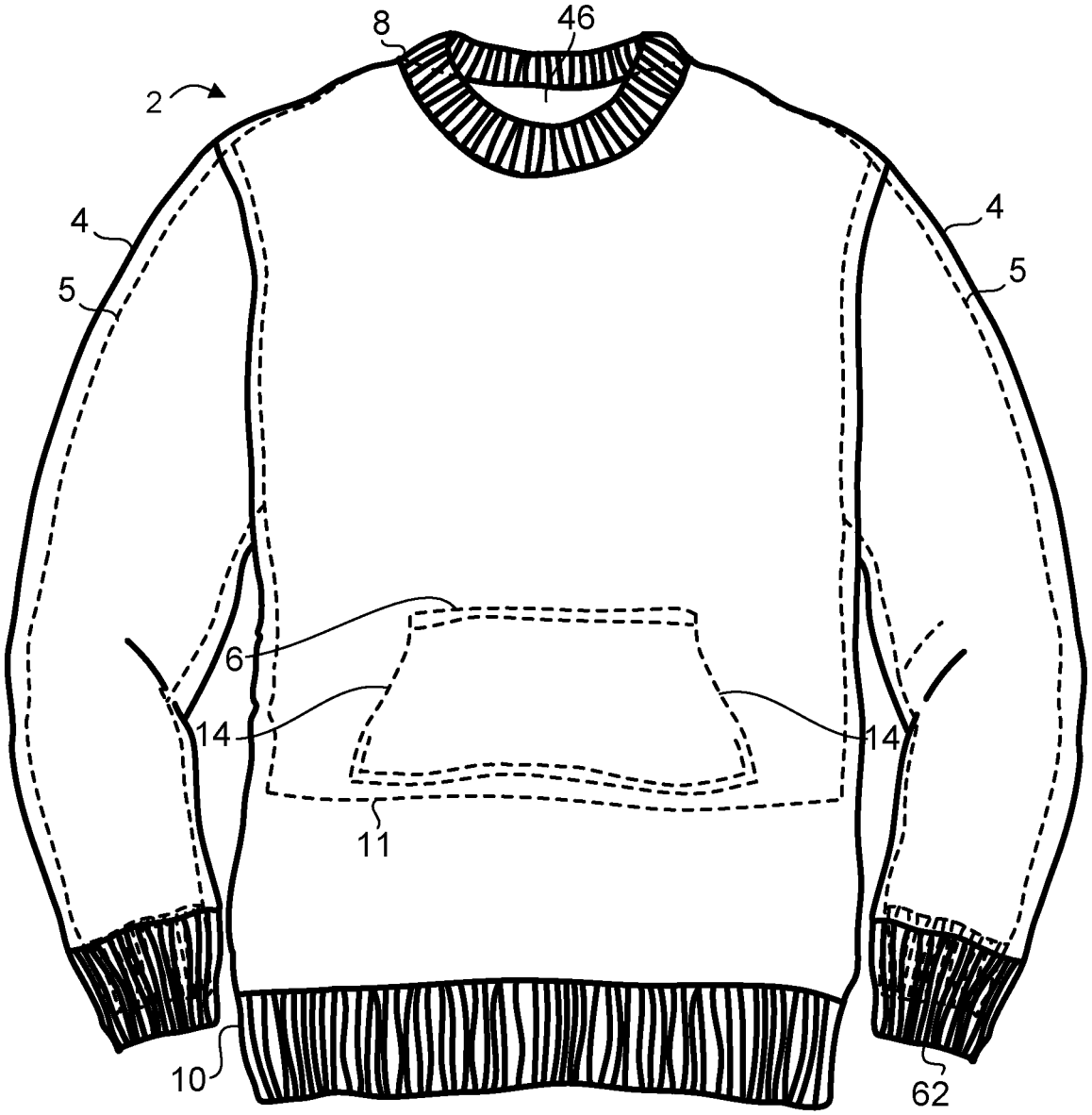
FIG. 1 is a front partially transparent view of one embodiment according the present article of clothing.

2-article of clothing
4-outer sleeve
5-inner sleeve
6-pocket
8-collar portion
10-outer body of article of clothing
11-inner body of article of clothing
12-connecting portion
14-opening of pocket
16-wearer's arm
18-wearer's hand
20-sleeve pocket
22-sleeve cutout
24-inside sheet
26-first surface of inside sheet
28-second surface of inside sheet
30-pocket of inside sheet
32-pocket of hood
34-heat pack
36-internal pocket
38-hood
40-zipper
42-sleeve pocket with opening disposed in the same direction as the opening of the sleeve to which the sleeve pocket is attached
44-attachment or closure means, e.g., complementary hook and loop system
46-neck opening
48-nape pocket
50-opening
52-lower back pocket
54-opening
56-outside surface of sleeve
58-inside surface of sleeve
60-bottom edge of sleeve
62-cuff
64-opening
66-opening
68-innermost surface of front sheet
70-outermost surface of front sheet
72-breast pocket
74-opening

PARTICULAR ADVANTAGES OF THE INVENTION

The present article of clothing allows its wearer to keep warm without requiring additional and separate articles of clothing, thereby reducing the chance that one or more disparate articles of clothing will be lost or separated. The additional coverings of the present article of clothing are integrally formed with the article of clothing, removing the need for the wearer of the article of clothing to remember to bring along loose, unattached items, e.g., gloves, etc. to keep warm. The present article of clothing allows its wearer to keep warm by bringing the wearer's upper extremities close to the wearer's core or torso and/or by covering the wearer's hands within pockets disposed on internal surfaces of the sleeves.

The present article of clothing allows its wearer to wear an article of clothing that, on its outward appearance, look normal and ubiquitous and provides additional features which can keep its wearer warmer.

The present article of clothing allows its wearer to keep warm by having appropriate amounts of covering on various portions of the wearer's body.

DETAILED DESCRIPTION OF A PREFERRED EMBODIMENT

The term "about" is used herein to mean approximately, roughly, around, or in the region of. When the term "about" is used in conjunction with a numerical range, it modifies that range by extending the boundaries above and below the numerical values set forth. In general, the term "about" is used herein to modify a numerical value above and below the stated value by a variance of 20 percent up or down (higher or lower).

The term "body" is used herein to mean a portion of an article of clothing configured to substantially cover the torso of a wearer and includes a front sheet that is connected to a rear sheet. When disposed on the wearer, the front sheet is configured to protect or cover the front side, e.g., chest and abdomen areas of the wearer's torso while the rear sheet is configured to protect or cover the rear side, e.g., back of the wearer's torso. Although described as the "front" or "rear" sheet, the body is essentially a single continuous piece of fabric or pieces of fabric that have been sewn or otherwise attached together. The reference to front or rear sheet facilitates the ensuing description with regard to the positioning of pockets or other features on the article of clothing. The body includes two sleeve openings configured to accommodate two sleeves, one on each side of the body and a neck opening or a collar portion on the top end of the body, from which a hood may extend.

The term "sleeve" is used herein to mean a portion of an article of clothing configured to substantially cover the upper extremities of a wearer. A sleeve is configured to extend from one side of the body.

The term "hood" is used herein to mean a portion of an article of clothing configured to substantially cover the head of a wearer and extend from a neck opening of the body of an article of clothing. When erected over a wearer's head, the hood substantially covers the wearer's head leaving the wearer's face substantially unobstructed.

The term "pocket" is used herein to mean a pouch or container made substantially from a material similar to the materials used in the construction of an article of clothing to which the pocket is attached. In some embodiments, a pocket can have two openings disposed substantially on opposing ends of the pocket. In some embodiments, a pocket is divided into separate compartments such that access to one compartment is blocked from one of the other compartments. In some embodiments, a pocket includes only one opening. In some embodiments, a pocket, e.g., an internal pocket, includes a cover or flap used in selectively restricting access to the contents of the pocket through an opening of the pocket. An internal pocket, e.g., one configured for securing a heat pack may be sewn to the article of clothing or may be removably secured using hook and loop patches.

Figure 2:
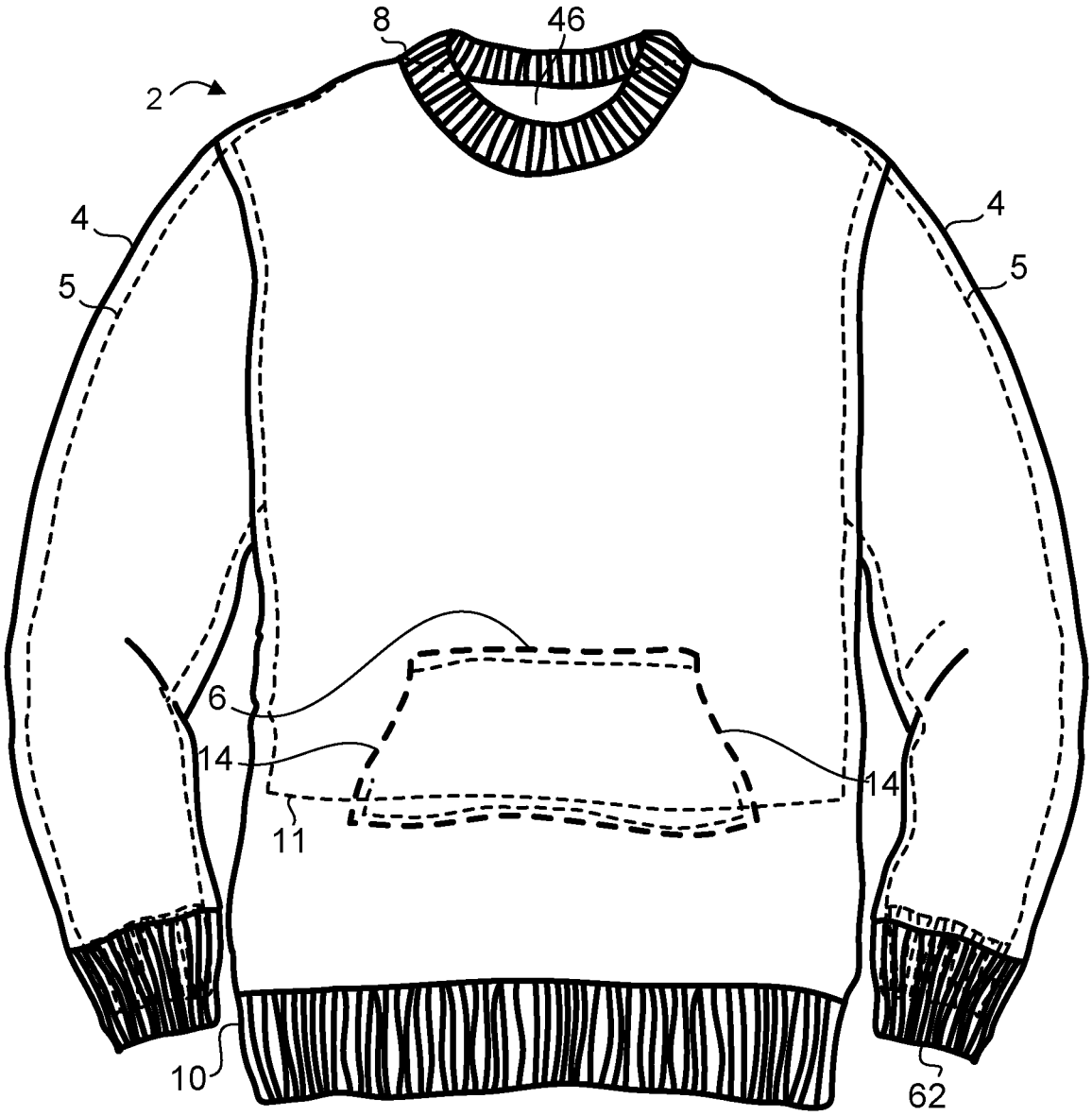
FIG. 2 is a front partially transparent view of another embodiment according the present article of clothing.
Figure 3:
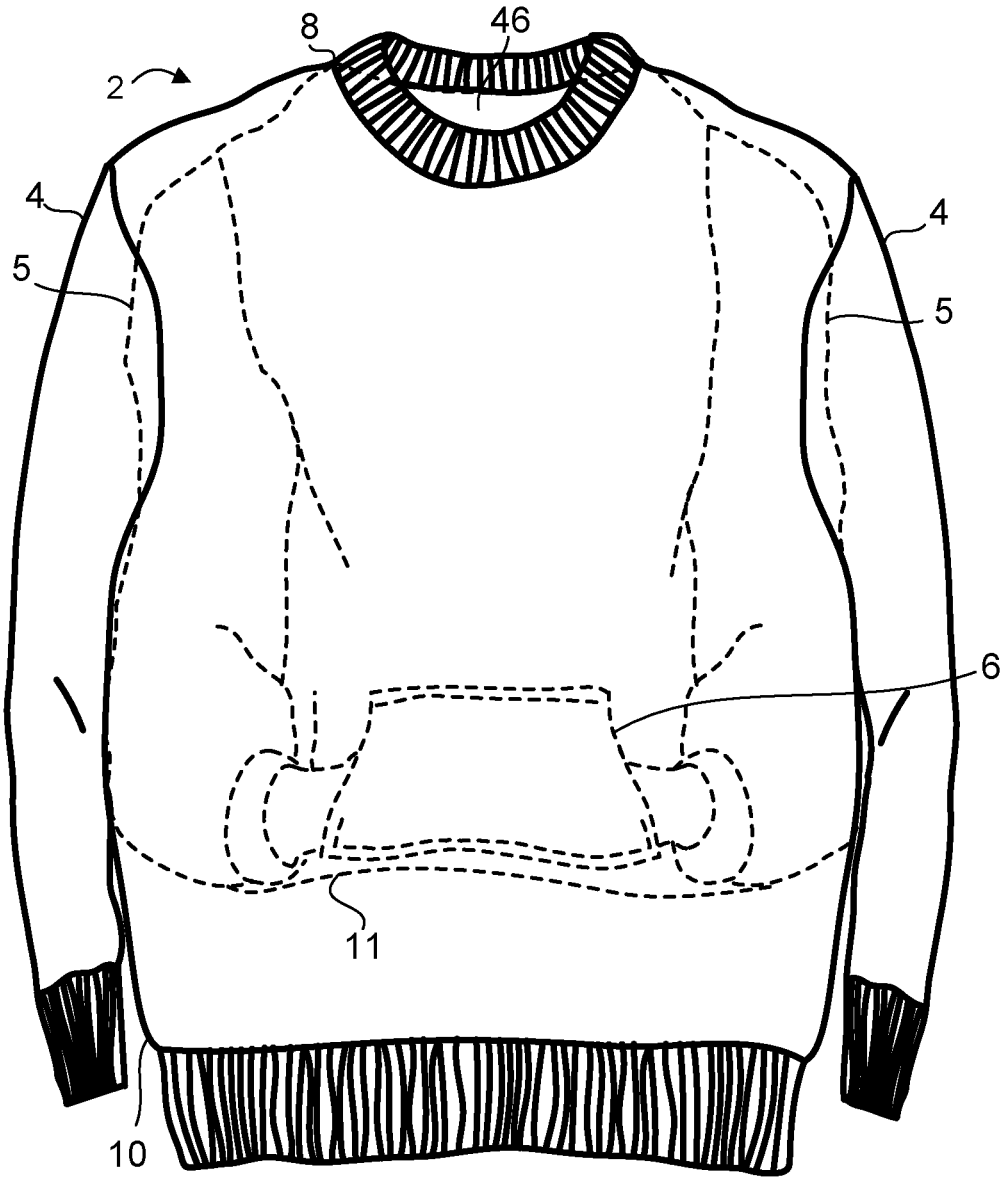
FIG. 3 is a front partially transparent view of the embodiment according to FIG. 1, depicting the wearers' arms having been retracted and disposed within the outer body of the article of clothing.
Figure 4:
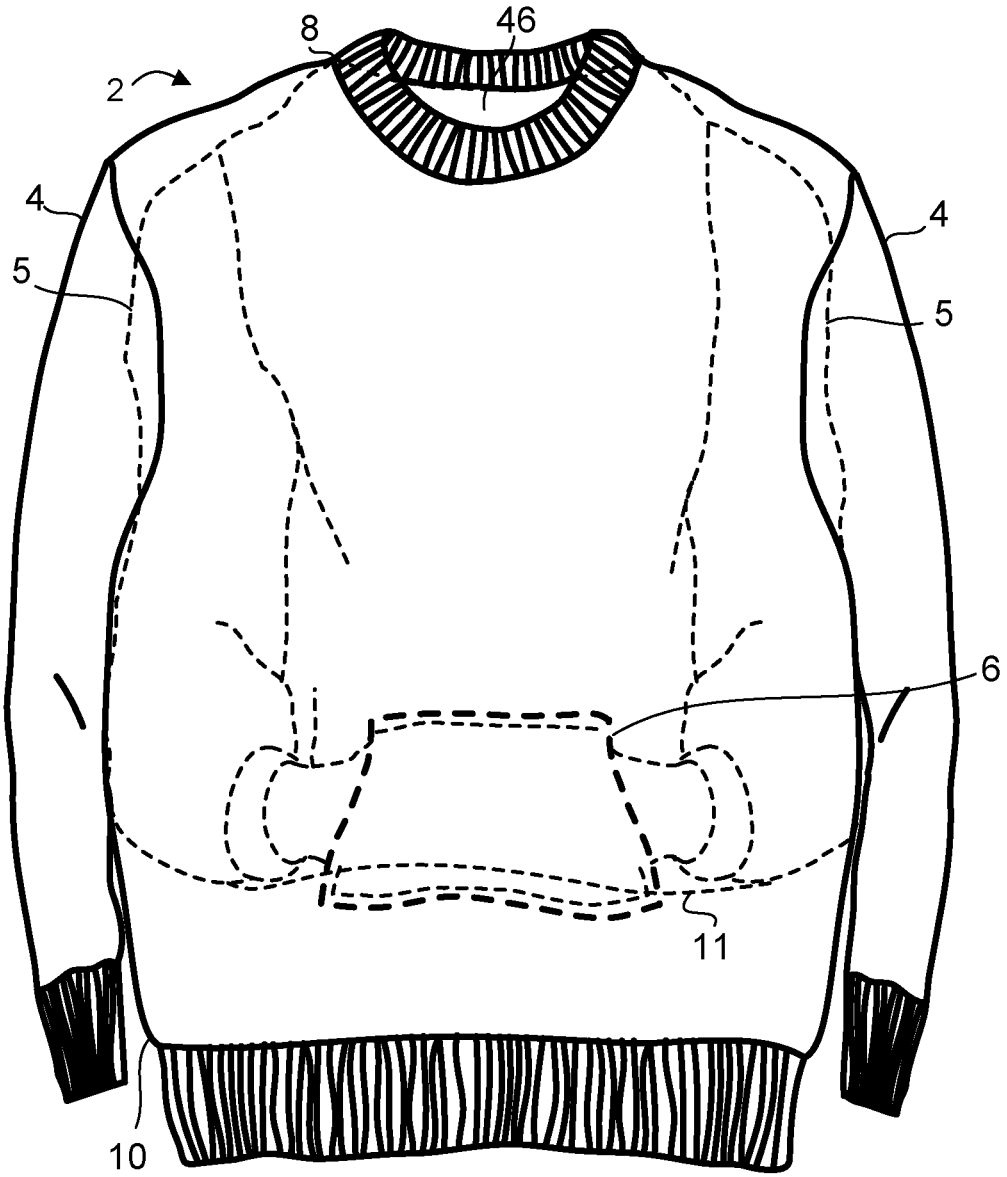
FIG. 4 is a front partially transparent view of the embodiment according to FIG. 2, depicting the wearers' arms having been retracted and disposed within the outer body of the article of clothing.

FIG. 1 is a front partially transparent view of one embodiment according the present article of clothing. FIG. 2 is a front partially transparent view of another embodiment according the present article of clothing. FIG. 3 is a front partially transparent view of the embodiment according to FIG. 1, depicting the wearers' arms having been retracted and disposed within the outer body 10 of the article of clothing. FIG. 4 is a front partially transparent view of the embodiment according to FIG. 2, depicting the wearers' arms having been retracted and disposed within the outer body of the article of clothing.

Disclosed herein is an article of clothing 2, e.g., a sweater, adapted for use by a wearer, the article of clothing including an outer body 10 and an inner body 11. The outer body 10 includes a front sheet, a collar portion 8, a pair of sleeves 4, each sleeve 4 extending from one side of the outer body 10. The inner body 11 includes a front sheet, a collar portion 8, a pair of sleeves 5, each sleeve 5 extending from one side of the inner body 11. The collar portion 8 of the inner body 11 is attached to the collar portion 8 or neck opening 46 of the outer body 10. In one embodiment, the collar portion 8 of the inner body 11 is sewn to the collar portion 8 of the outer body 10. Other means of attaching the collar portions 8 or the two bodies 10, 11 can also be used, i.e., by gluing, taping or patching one collar portion 8 to another, etc. The length of the inner body 11 is preferably shorter than the length of the outer body 10 such that its wearer will not feel excessively warm with two layers of covering the entire upper body of the wearer including his extremities. It shall be noted in FIGS. 1-4 that the inner body 11 does not extend the entire length of the outer body 10. The inner body 11 is disposed within the outer body 10. Each sleeve 5 of the pair of sleeves 5 of the inner body 11 is configured to be insertable through a sleeve 4 of the pair of sleeves 4 of the outer body 10 and retractable from a sleeve 4 of the pair of sleeves 4 of the outer body 10 as shown in FIG. 3. In the embodiment shown in FIG. 1, the front sheet of the inner body 11 includes an outer surface and a pocket 6 disposed on the outer surface of the inner body 11. In another embodiment, the front sheet of the outer body 10 includes an inner surface and a pocket 6 disposed on the inner surface of the outer body 10 as shown in FIG. 2. In one embodiment, the pocket 6 includes two openings 14, each adapted for access with one hand of the wearer. Referring back to Nejad, although Nejad also discloses an internal pocket, Nejad's internal pocket is accessed via a poncho type covering. Therefore, incentive exists for Nejad to want to provide an internal pocket. With the present article of clothing, there lacks motivation to want to dispose an internal pocket which can only be accessed using arms not put through the normal sleeves in most configurations.

In donning a present article of clothing or sweater 2 and if the inner sleeves 5 have already been disposed within the outer sleeves 4 and the wearer desires a normal look, the sweater 2 may be put on in a manner consistent with the manner in which normal sweaters are donned. If the inner sleeves 5 have been retracted and disposed within the outer body 10, the wearer may first put the inner body 11 over his head and proceed to insert his arms in the inner sleeves 5 before inserting his now inner sleeve-covered arms in the outer sleeves 4. At any time when a "no arms" look is desired, the wearer may grasp a bottom portion of an outer sleeve 4 and proceed to pull the still inner sleeve-covered arm from the inside of the outer sleeve 4 and place it within the outer body 10. The wearer may proceed to put the hand inside the pocket 6. In this configuration, the wearer has now covered his entire upper torso, including all of his upper extremities for additional warmth. While having the sweater 2 in this configuration, if the wearer no longer needs the sweater, the wearer may proceed to grasp the bottom ledge of the outer body 10 and bend his arm to lift and remove the outer body 10. At this point, the wearer can proceed to remove the sweater 2 in a manner consistent with the manner in which conventional sweaters are taken off a body.

It shall be noted that the articles of clothing shown in FIGS. 1-4 appear normal or ubiquitous although the construction details of the interior of the article of clothing 2 are different from conventional sweaters. In one embodiment, each pocket 6 includes two openings 14, each adapted for access with one hand of the wearer. In use, when the inner sleeves 5 are retracted, the wearer's hands may be inserted in the pocket 6 disposed either on the inner body 11 or the outer body 10.

Figure 5:
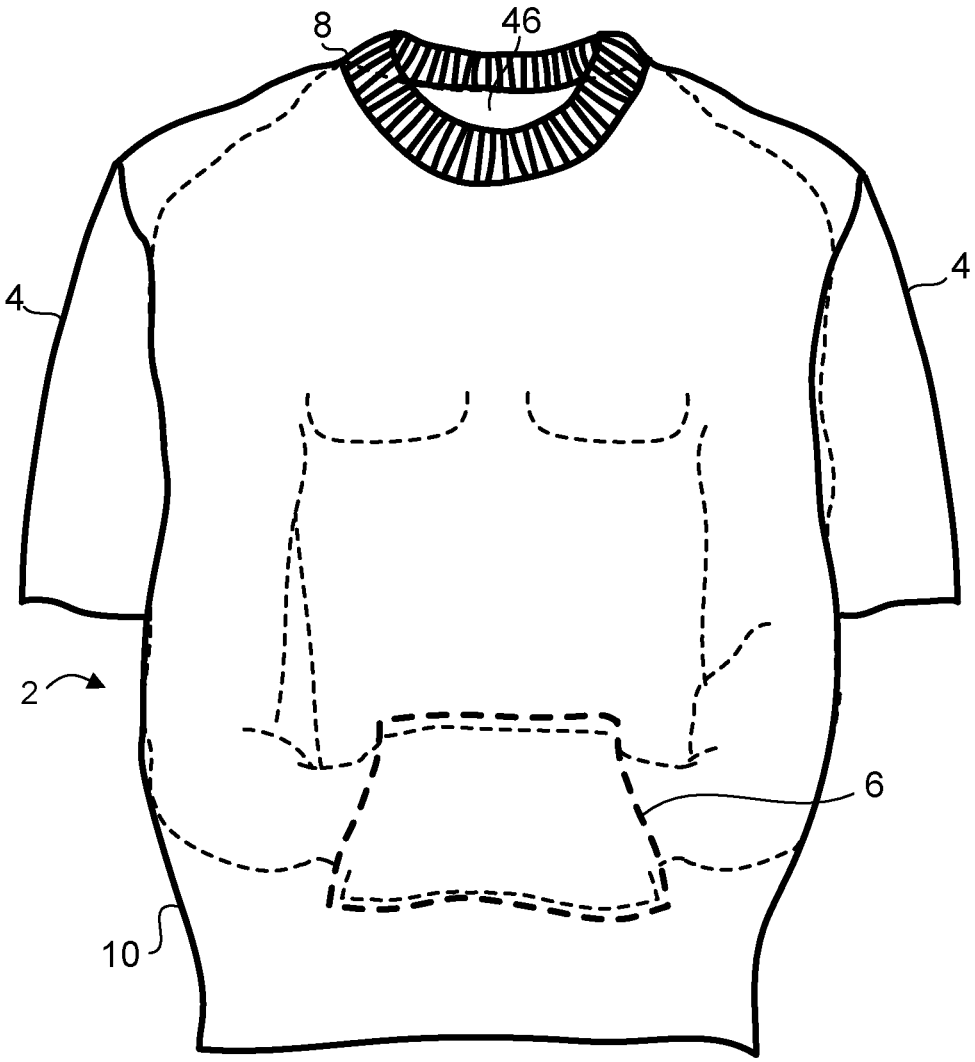
FIG. 5 is a front partially transparent view of yet another embodiment according to the present article of clothing.

FIG. 5 is a front partially transparent view of yet another embodiment according to the present article of clothing 2. In this embodiment, the article of clothing 2 is a short-sleeved T-shirt. No inner body is available in this embodiment. A pocket 6 is disposed on the innermost surface of the front sheet of the outer body 10. In another example not shown, a long sleeved T-shirt can also be used with a similar body construction details as the embodiment shown in FIG. 5.

Figure 6:
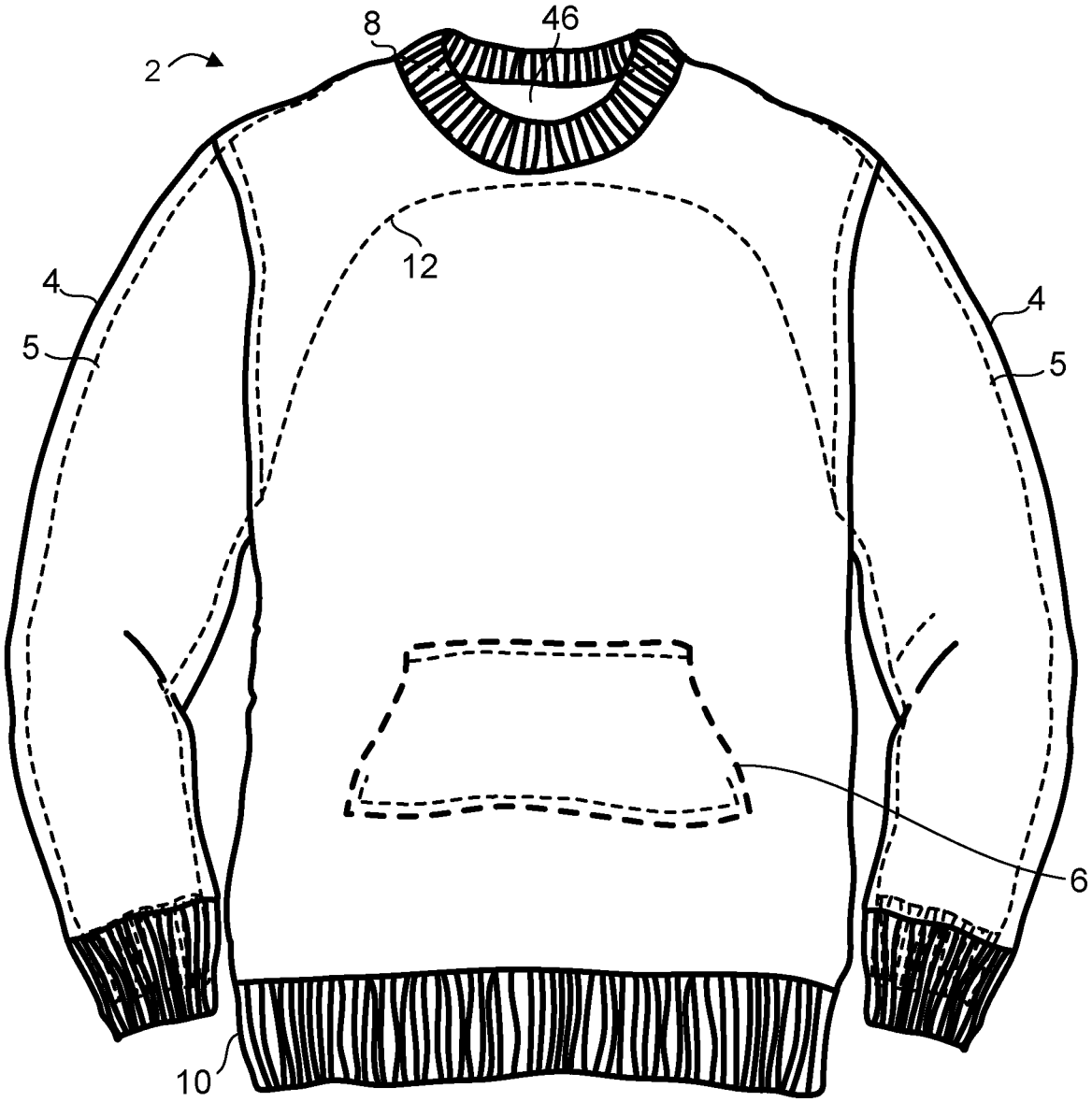
FIG. 6 is a front partially transparent view of another embodiment according to the present article of clothing.

FIG. 6 is a front partially transparent view of another embodiment according to the present article of clothing. It shall be noted that, instead of an inner body 11 as shown in FIG. 1, the two inner sleeves 5 are merely held together using a connecting portion 12 which spans approximately only the shoulder area. This embodiment is suitable for those preferring light additional materials that adds warmth to the arms and the hands when they are disposed within the pocket 6.

Figure 7:
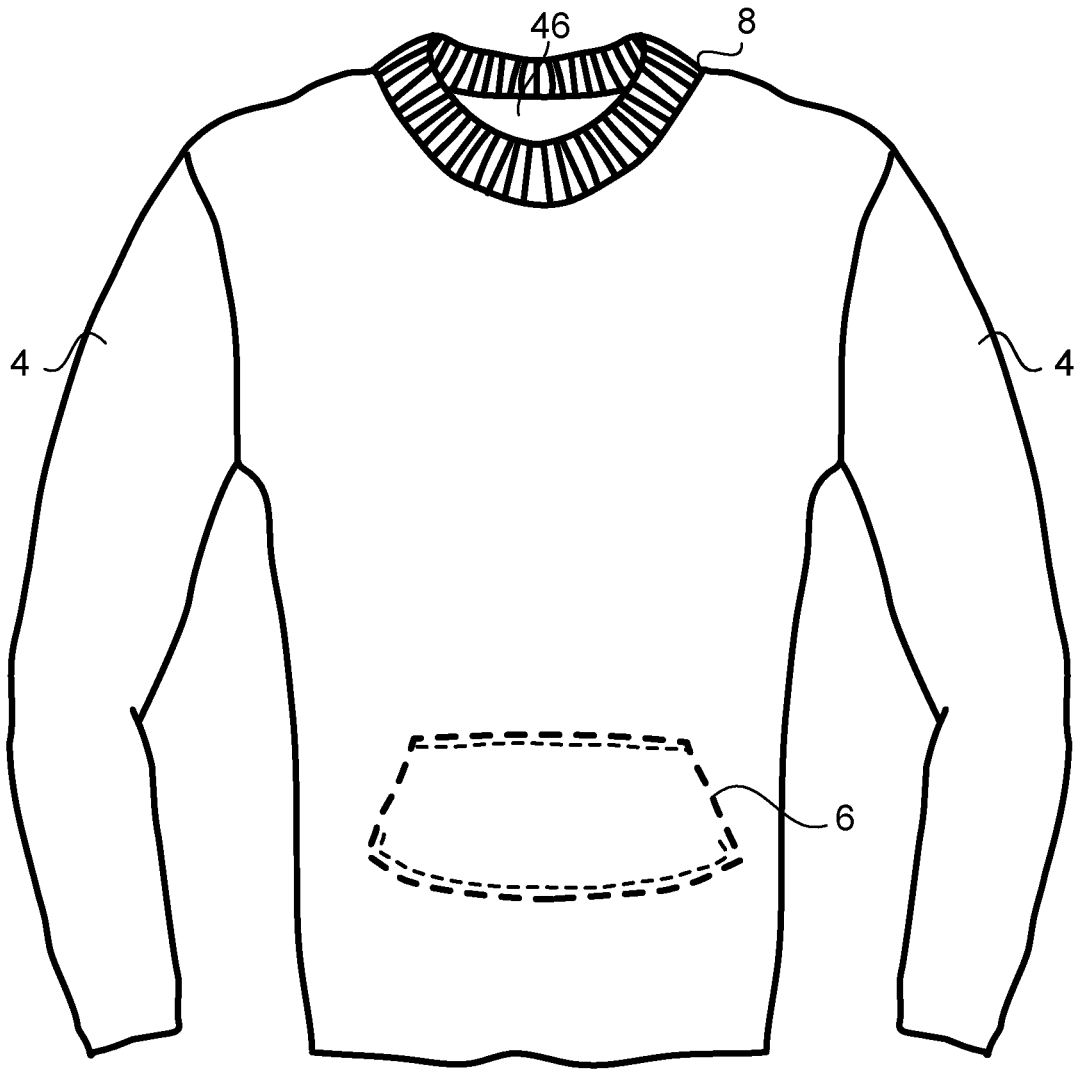
FIG. 7 is a front partially transparent view of another embodiment according to the present article of clothing, depicting an inside pocket.
Figure 8:
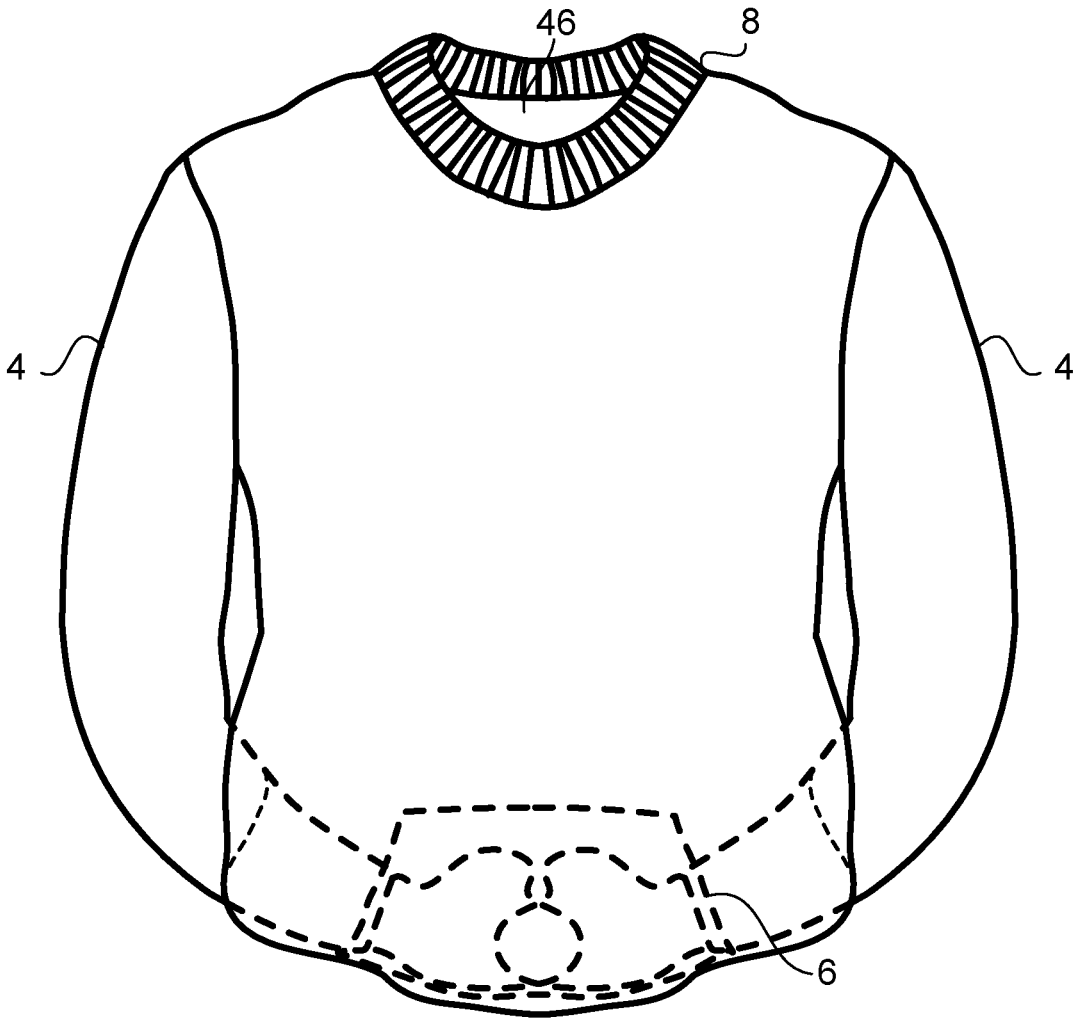
FIG. 8 is a front partially transparent view of another embodiment according to the present article of clothing, depicting an inside pocket accessed from outside and bottom edge of the article of clothing.

FIG. 7 is a front partially transparent view of another embodiment according to the present article of clothing, depicting an inside pocket 6. FIG. 8 is a front partially transparent view of another embodiment according to the present article of clothing, depicting an inside pocket accessed from pockets from outside and bottom edge of the article of clothing. Referring to FIG. 7, the article of clothing is a compression fit shirt. A wearer of such shirt is often a minimalist or otherwise engaged in a sports activity and therefore typically does not carry other pieces of clothing, e.g., a jacket. If outdoor weather turns colder, the wearer may resort to inserting otherwise exposed hands in the pocket disposed on the innermost surface of the front sheet of the article of clothing as shown in FIG. 8. Therefore, while the present article of clothing provides looks that do not draw attention from others, it provides its wearer a choice to add additional warmth when desired.

Figure 9:
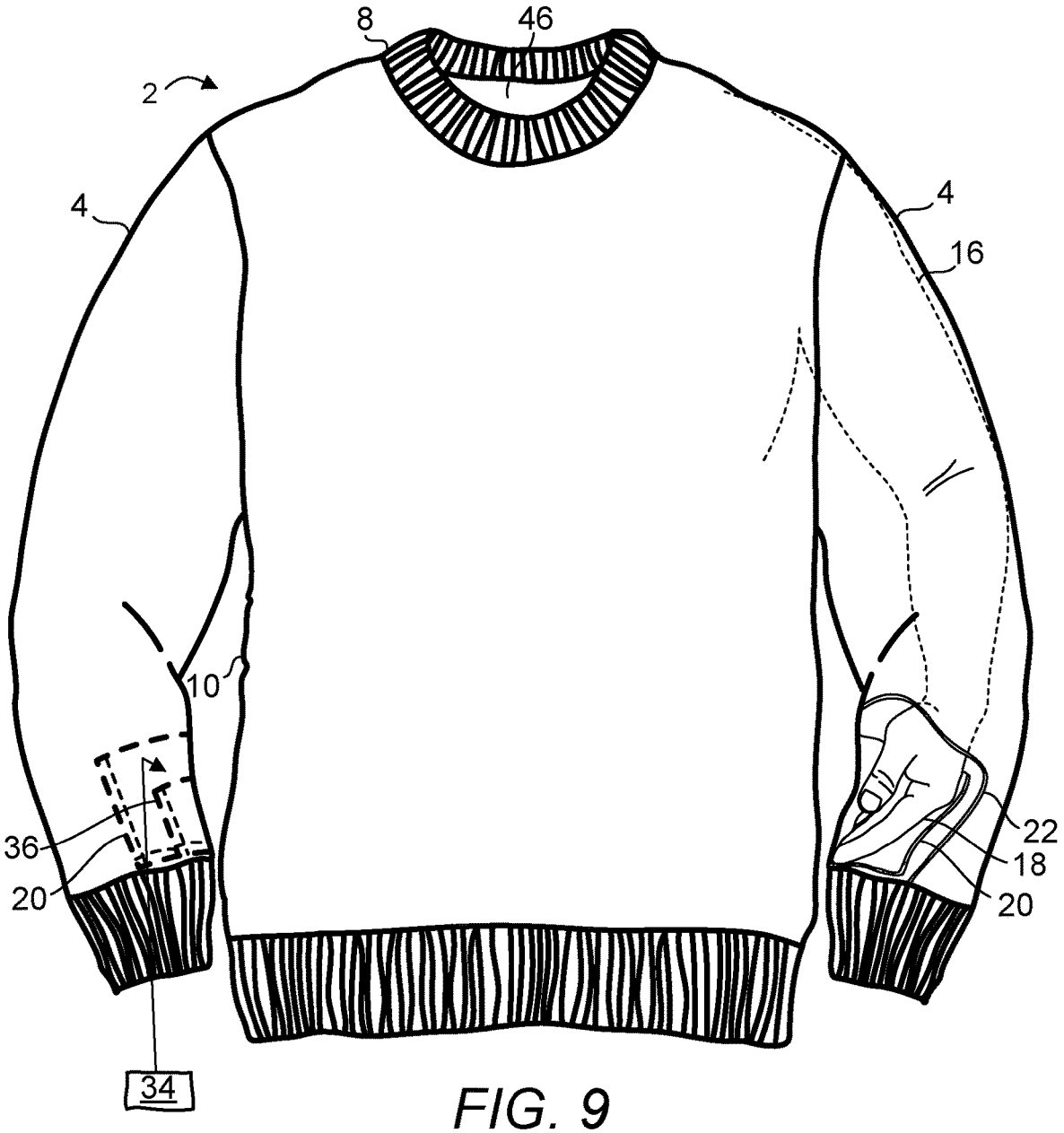
FIG. 9 is a front partially transparent view of another embodiment according to the present article of clothing, depicting inside pockets disposed at sleeves.

FIG. 9 is a front partially transparent view of another embodiment according to the present article of clothing, depicting inside pockets 20 disposed at sleeves 4. Again, disclosed is an article of clothing adapted for use by a wearer having a torso having a front side, the article of clothing including a body 10 configured for covering the torso of a wearer. For sake of brevity, only a wearer's arm 16 and hand 18 are shown in FIG. 9. The body 10 includes two openings, each disposed on a side of the body 10, two sleeves 4, each sleeve 4 including a top end, a bottom end and an inside surface. The top end of each sleeve 4 is configured to be attached one of the two openings of the body 10. Each sleeve 4 includes a pocket 20 disposed on the bottom end of the inside surface of the sleeve. The pocket 20 includes an opening for accommodating one of the wearer's hands. In one embodiment, a pocket 20 is disposed at a portion of a sleeve 4 proximal to the body as shown in FIG. 9. In one embodiment, the pocket 20 of each sleeve further includes an internal pocket 36 attached to a portion of an interior surface of the pocket 20 of the sleeve 4. Each internal pocket 36 includes an opening configured for receiving a heat pack 34. Heat packs are portable heating devices, typically "activated" or prepared to give off heat only when additional heat from the packs is needed. In using an internal pocket 36, a wearer's arm is slightly retracted relative to the length of the sleeve 4 such that the wearer's hand can be inserted in the internal pocket 36. Notice that the wearer's hand 18 is shown inserted in the cross-sectional view of the internal pocket 36 of one of the sleeves 4 through a cutout 22. If a heat pack 34 is used, the hand 18 may be placed around and clenched to surround the internal pocket 36 shown in the other one of the sleeves 4.

Figure 10:
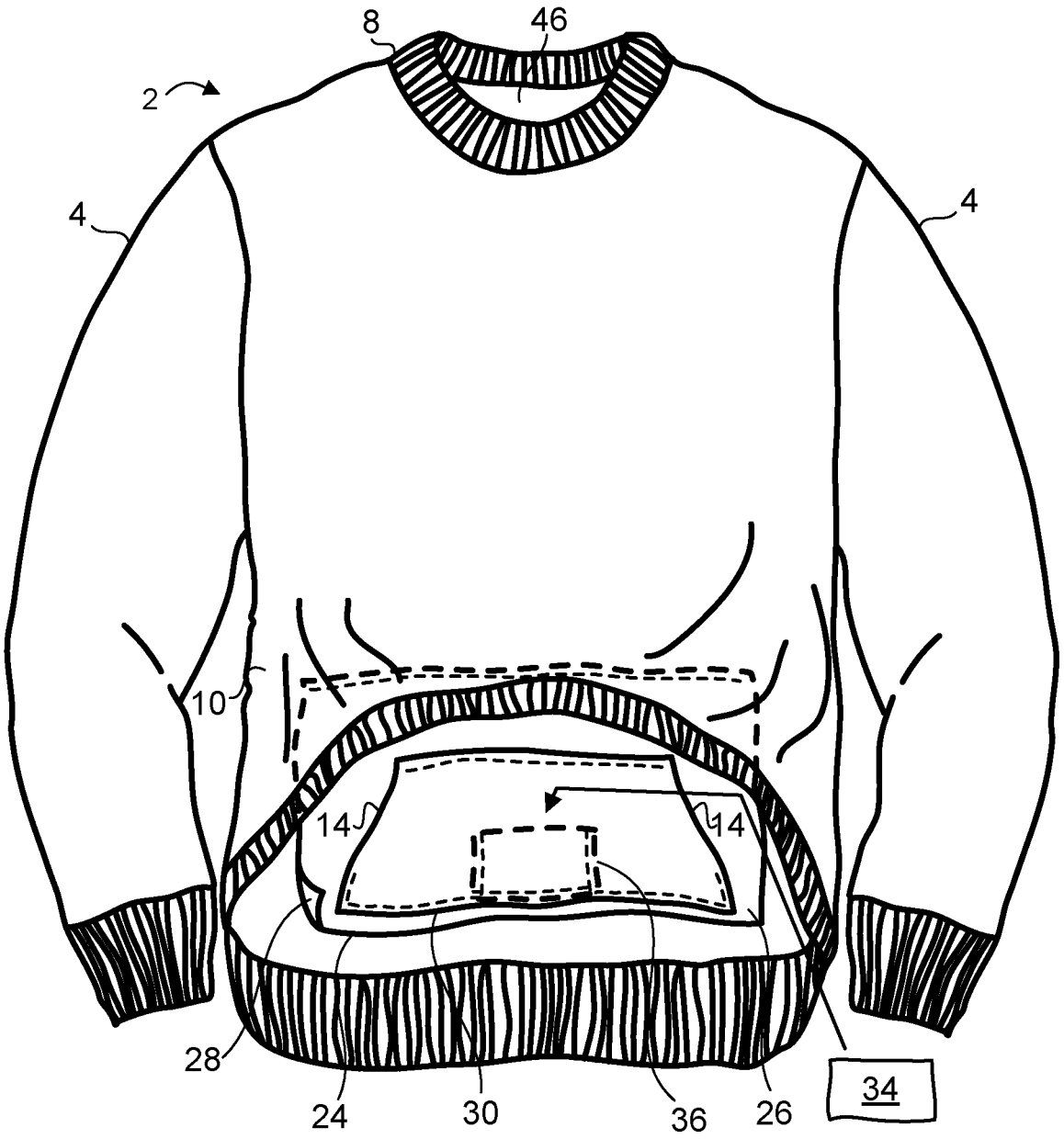
FIG. 10 is a front partially transparent view of another embodiment according to the present article of clothing, depicting a pocket that is disposed on an inside sheet.

FIG. 10 is a front partially transparent view of another embodiment according to the present article of clothing, depicting a pocket that is disposed on an inside sheet. The front sheet of the sweater is shown rolled up slightly to reveal the interior construction details. It shall be noted that the sweater shown in FIG. 10 is substantially similar to the sweater shown in FIG. 9. The sweater can have sleeve pockets as shown in FIG. 9 as well. In this embodiment, the body also includes a front sheet configured to cover the front side of a wearer's torso, the front sheet having an inner surface, an inside sheet 24 including a first surface 26, a second surface 28 and a pocket 30 disposed on the first surface 26. The first surface 26 faces toward the inner surface of the front sheet while the second surface 28 faces away from the inner surface of the front sheet. It shall be noted that the inside sheet 24 extends from a portion of the inner surface of the front sheet. Again, with this embodiment, a wearer can insert his hands in the pocket 30 through the openings 14 to bring the arms close to the core of the wearer's body. In one embodiment, at least one internal pocket 36 is further provided for securing at least one heat pack 34.

Figure 11:
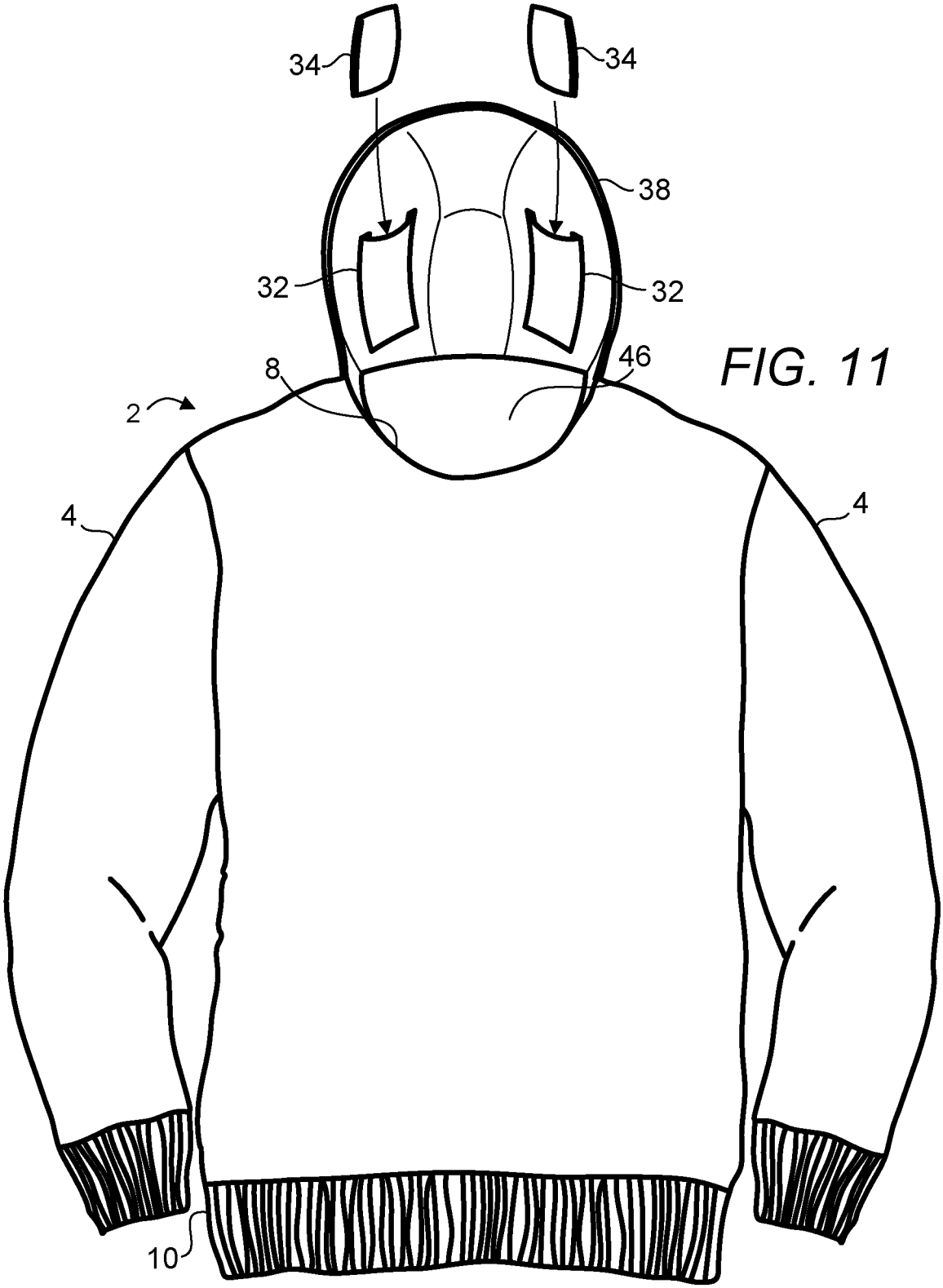
FIG. 11 is a front partially transparent view of another embodiment according to the present article of clothing, depicting pockets that are disposed within a hood.

FIG. 11 is a front partially transparent view of another embodiment according to the present article of clothing, depicting pockets 32 that are disposed within a hood 38. It shall be noted that the hood 38 is configured to extend from the collar portion 8, the hood including a pair of pockets 32, each pocket 32 is configured for receiving a heat pack 34. Each pocket 32 is preferably disposed at a location such that when disposed over a wearer, each pocket 32 is disposed substantially over an ear of the wearer to add warmth generally to the space within the hood 38 and specifically around the wearer's ears. In one embodiment, the hood 38 is configured to be double-layered to provide additional material to reduce heat loss through the hood.

Figure 12:
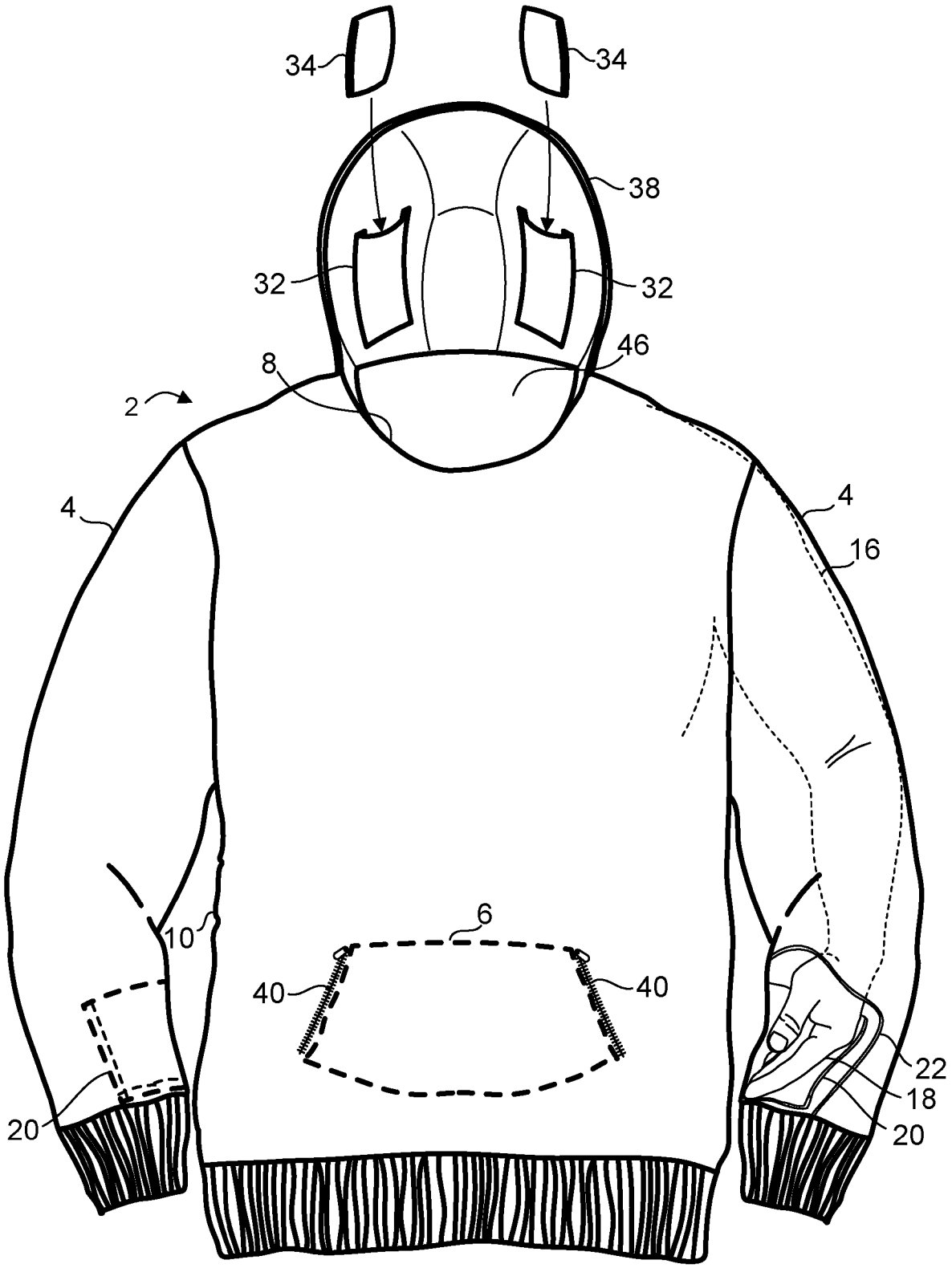
FIG. 12 is a front partially transparent view of another embodiment according to the present article of clothing, depicting a pocket disposed on the internal surface of the front sheet of the article of clothing, inside pockets disposed at sleeves and pockets that are disposed within a hood and the openings of the pocket of the front sheet closeable each with a zipper.
Figure 13:
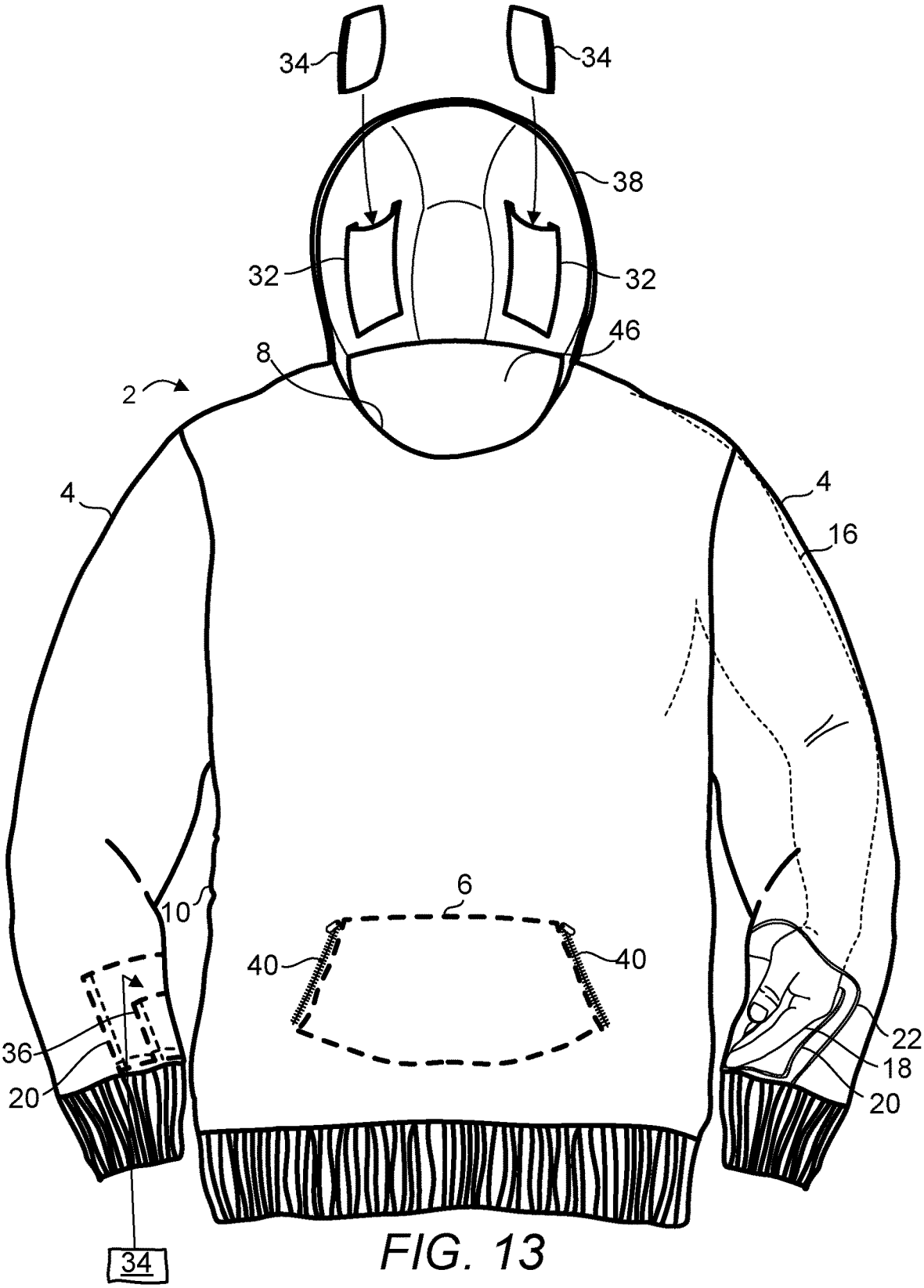
FIG. 13 depicts an article of clothing that is similar to the embodiment shown in FIG. 12 except at least one of the pockets at the sleeves is shown additionally with a pocket for holding a heat pack.
Figure 14:
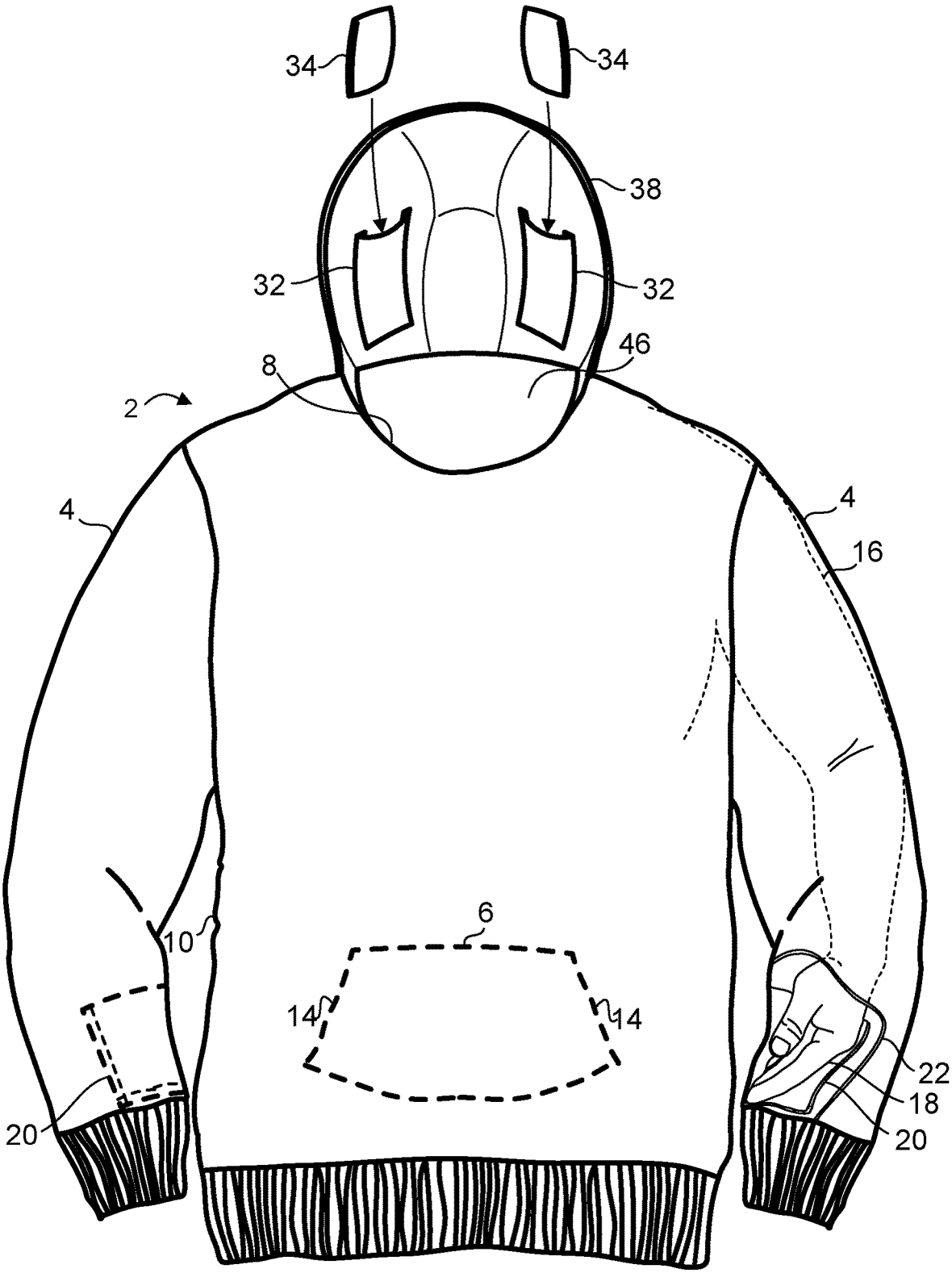
FIG. 14 depicts an article of clothing that is similar to the embodiment shown in FIG. 12 except at least one of the inside pockets on the sleeves is void of an internal pocket for holding a heat pack and the pocket of the front sheet is void of zipper-controlled accesses.
Figure 15:
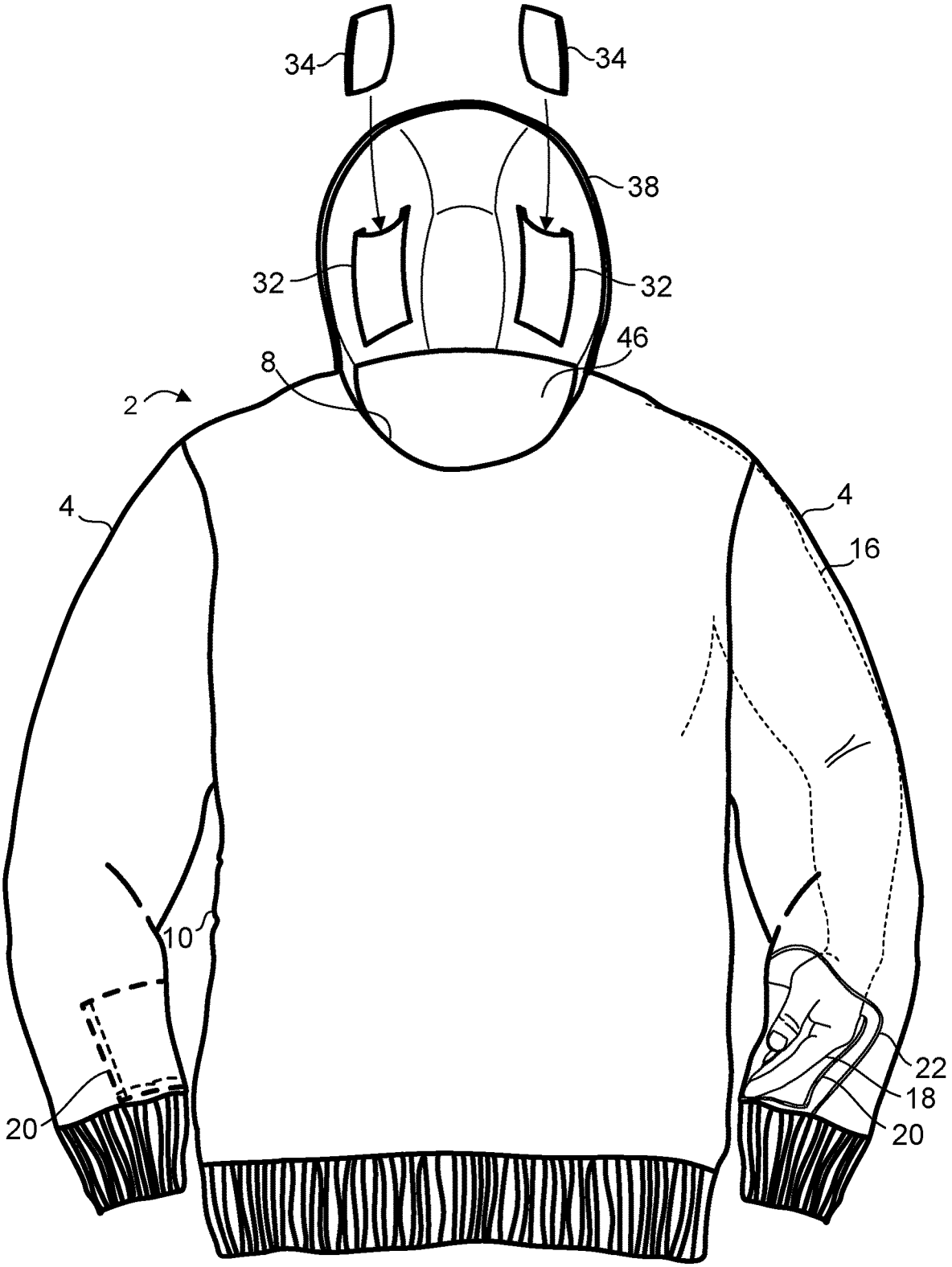
FIG. 15 depicts an article of clothing that is similar to the embodiment shown in FIG. 12 except the article of clothing is void of a pocket disposed on the front sheet.
Figure 16:
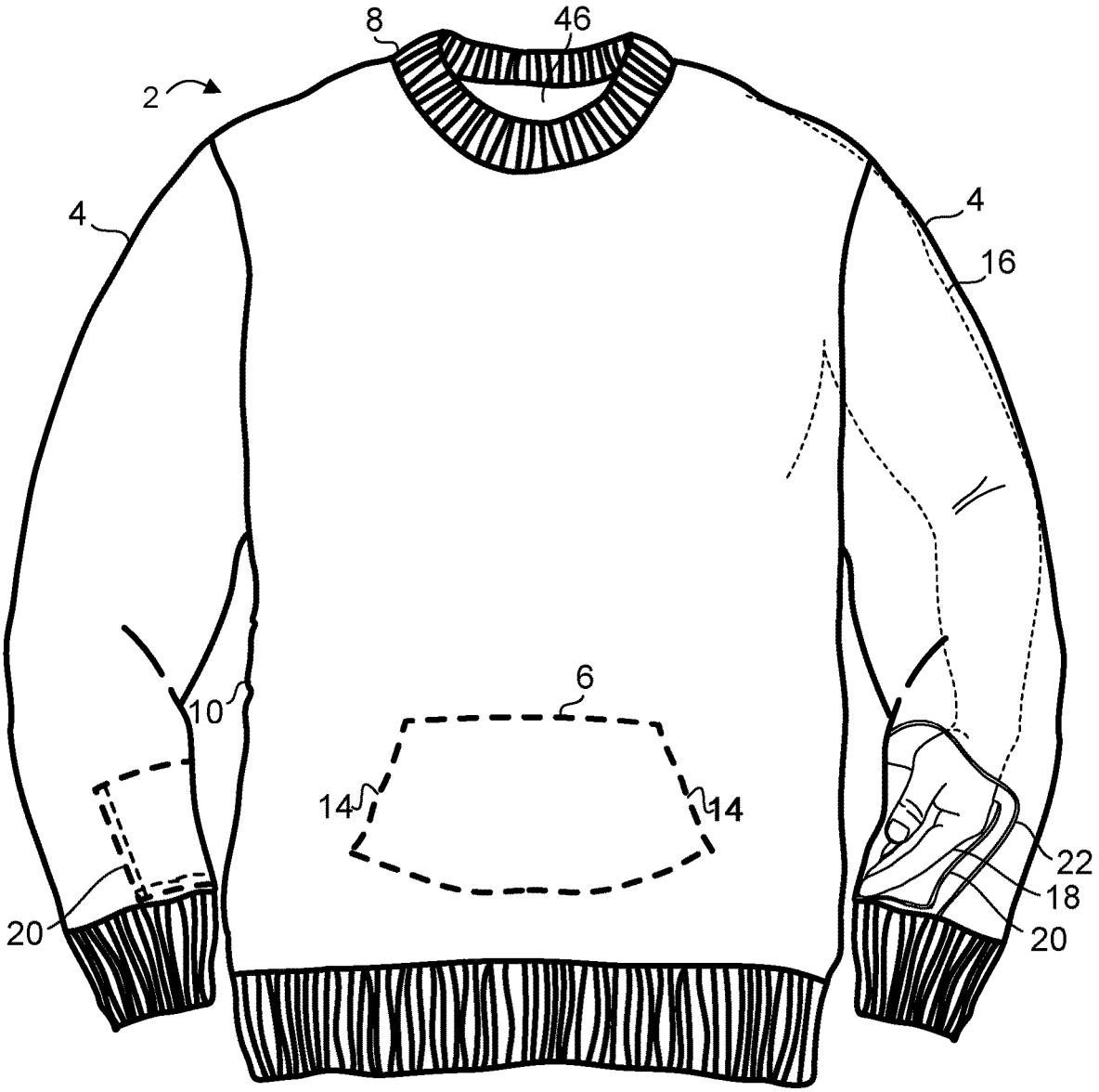
FIG. 16 depicts an article of clothing that is similar to the embodiment shown in FIG. 12 except the article of clothing is void of a hood.
Figure 17:
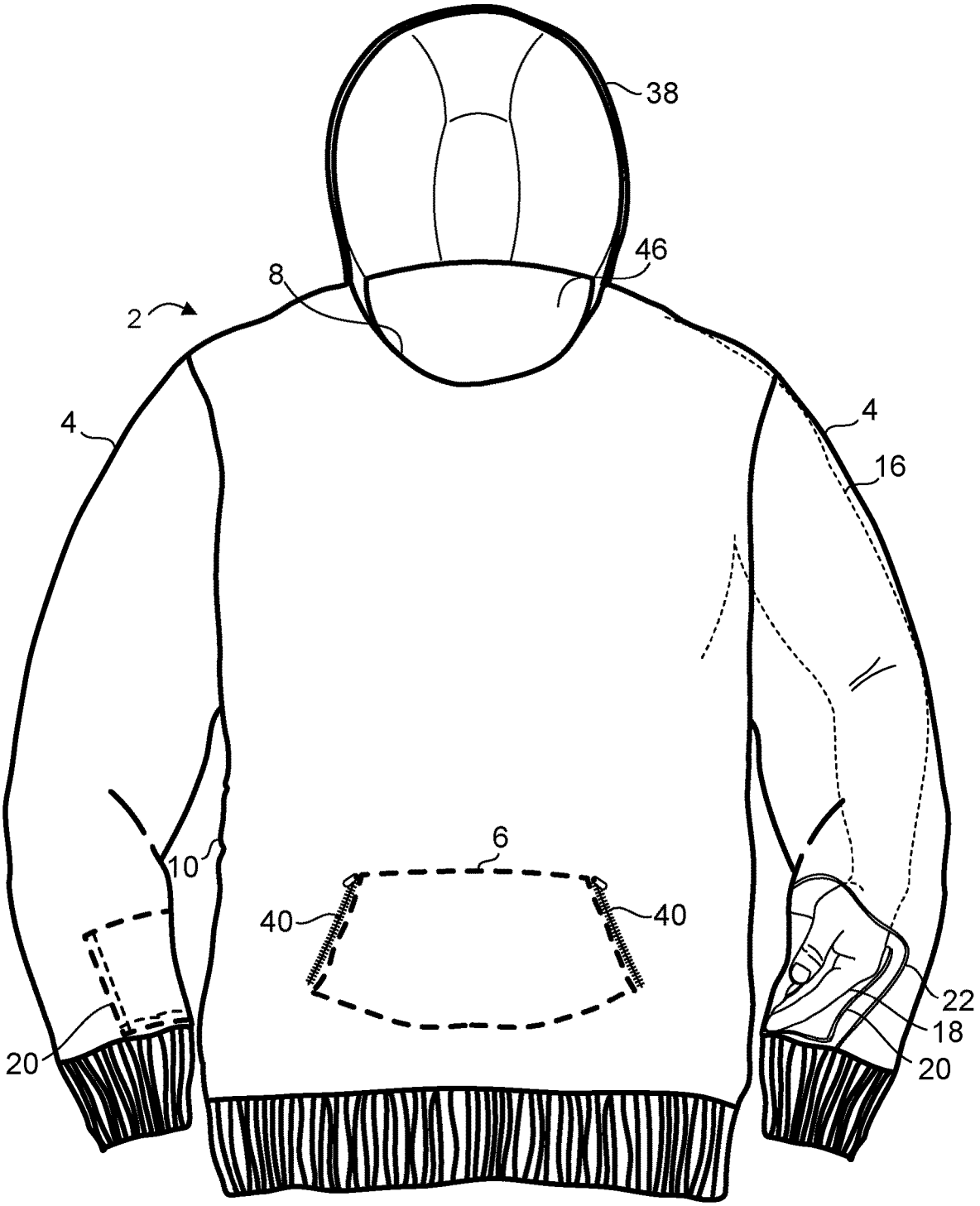
FIG. 17 depicts an article of clothing that is similar to the embodiment shown in FIG. 12 except the hood is void of pockets disposed therein.
Figure 18:
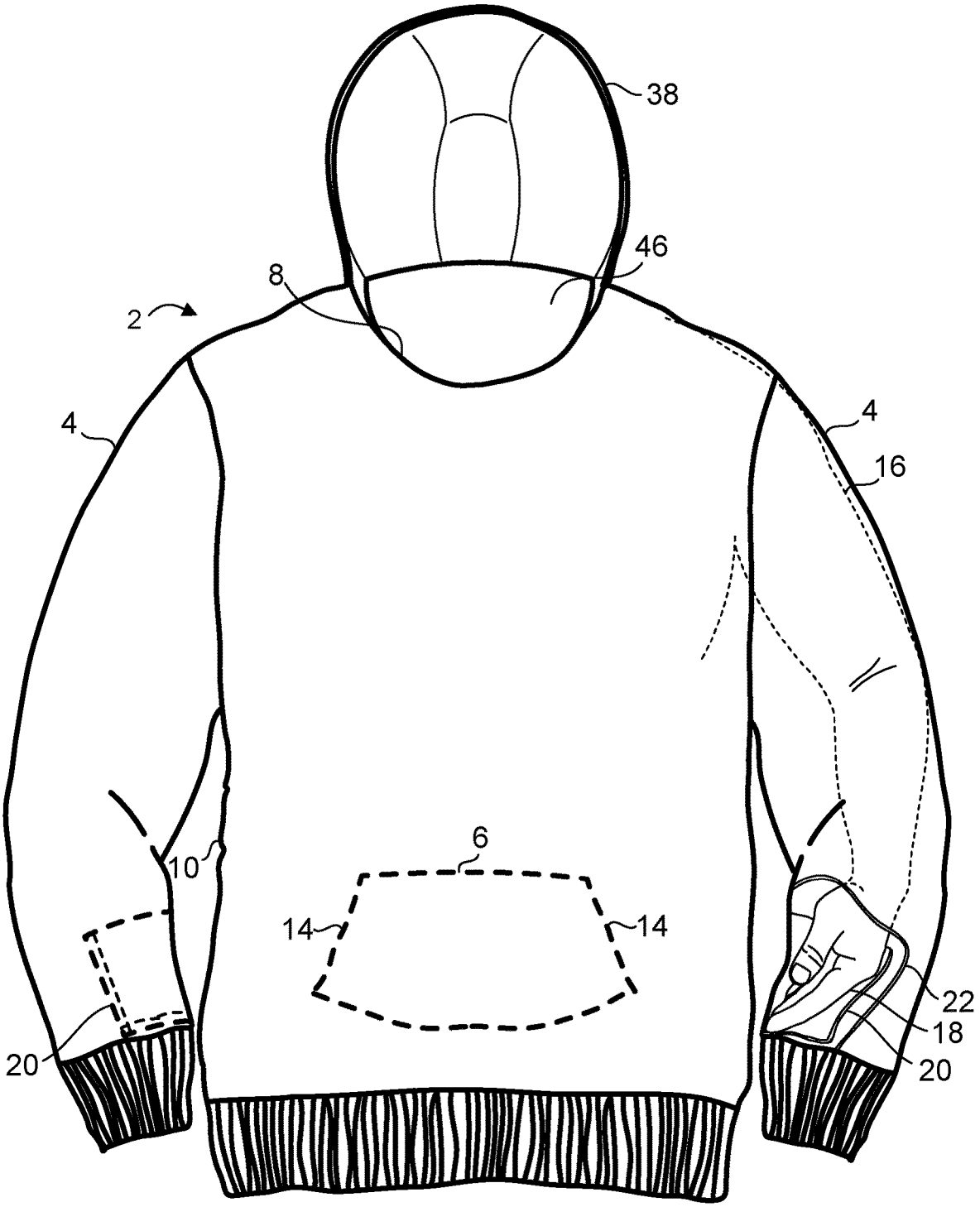
FIG. 18 depicts an article of clothing that is similar to the embodiment shown in FIG. 12 except the hood is void of pockets disposed therein and the access to the openings of pocket of the front sheet is not zipper-controlled.
Figure 19:
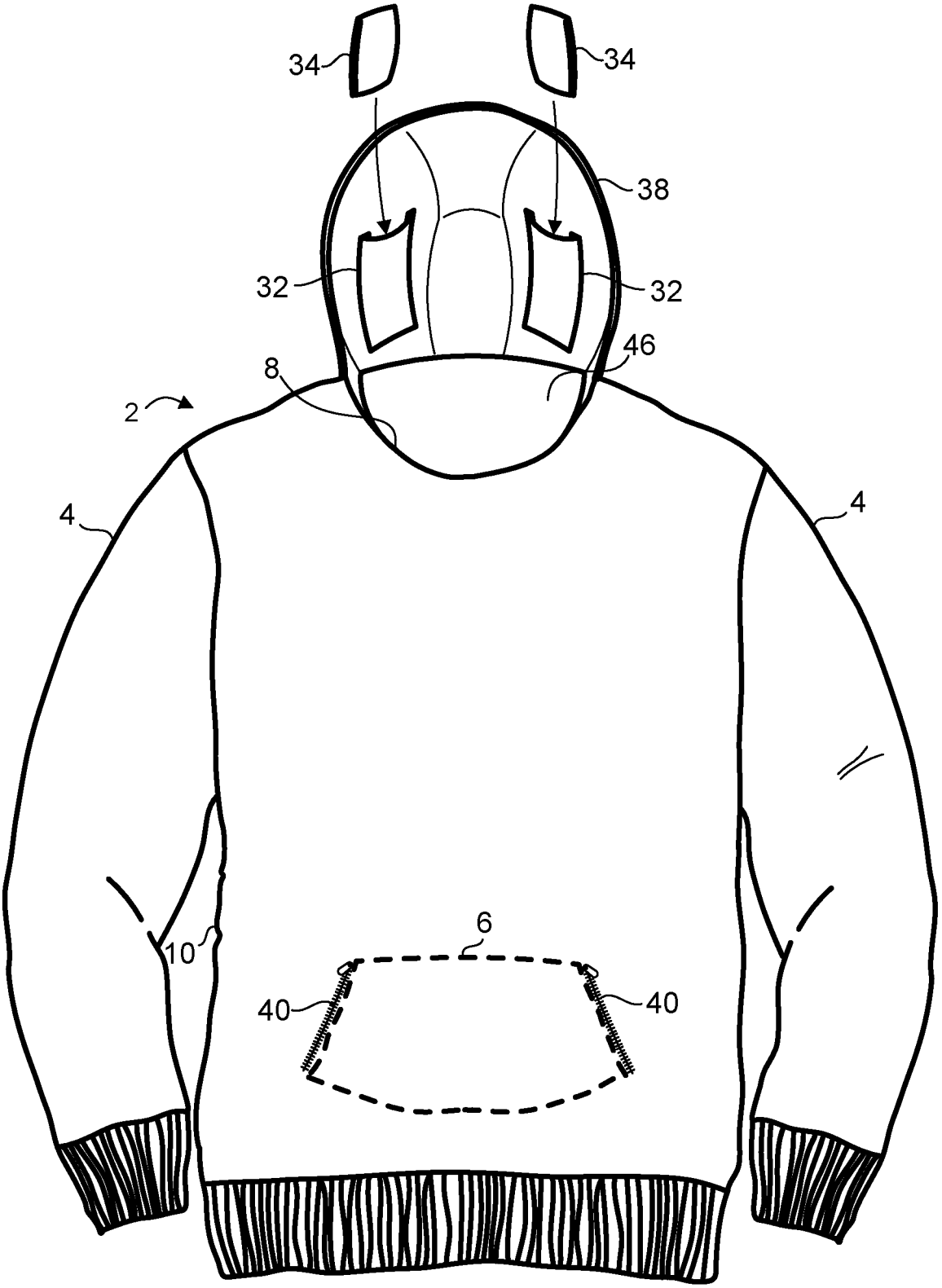
FIG. 19 depicts an article of clothing that is similar to the embodiment shown in FIG. 12 except the sleeves are void of pockets disposed therein.
Figure 20:
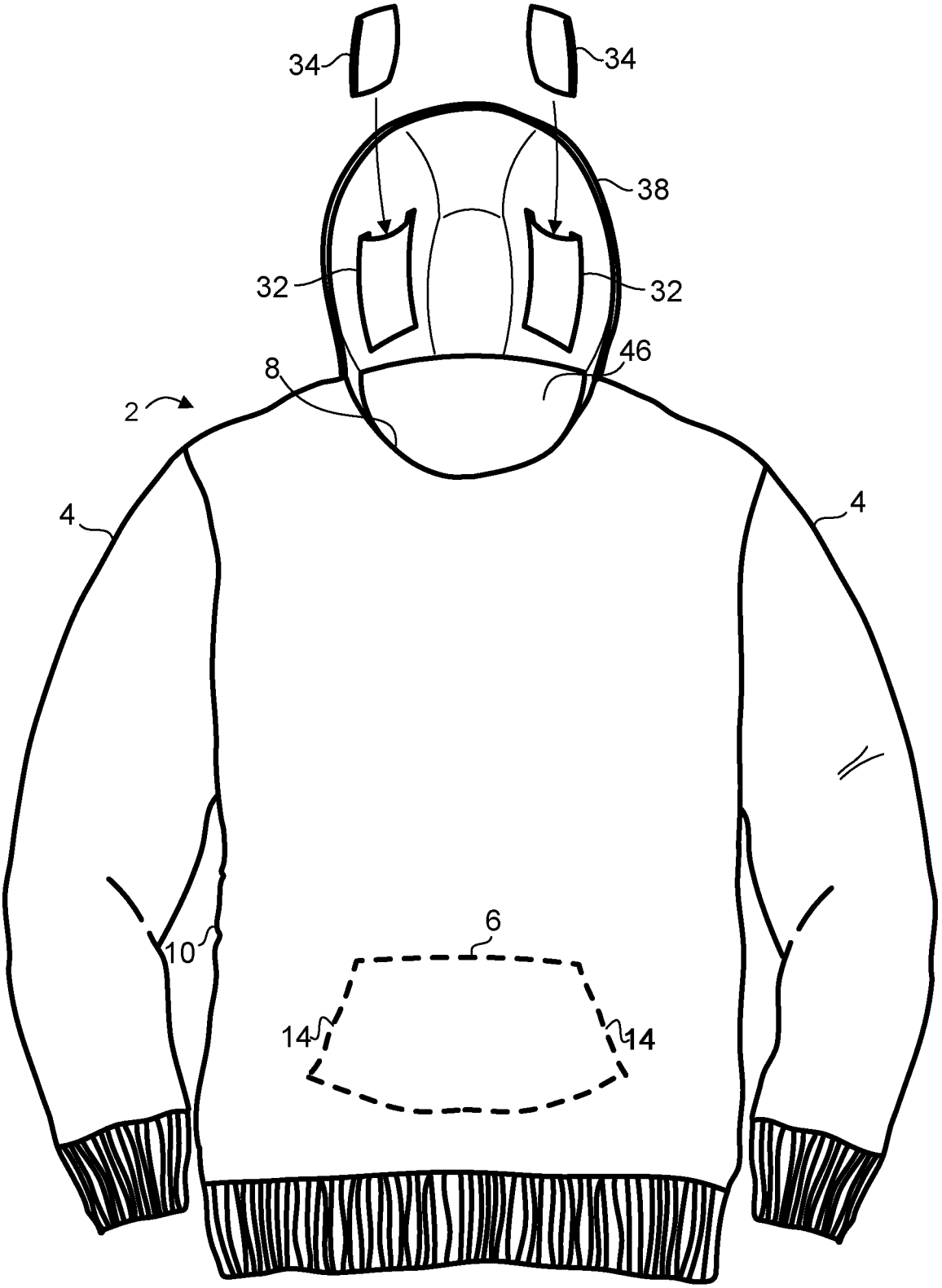
FIG. 20 depicts an article of clothing that is similar to the embodiment shown in FIG. 12 except the sleeves are void of pockets disposed therein and the pocket of the front sheet is void of zipper-controlled accesses.

FIGS. 12-24 depict various embodiments of the present article of clothing in which various combinations of pockets are used, each of which is configured for a suitable purpose at hand. For instance, for a wearer preferring to receive warmth from his or her torso, a pocket disposed within on the front sheet will be necessary while if a sleeve pocket is also available, the wearer can choose to insert his or her hand in the sleeve pocket instead when it is inconvenient or socially unacceptable to use the pocket of the front sheet. FIG. 12 is a front partially transparent view of another embodiment according to the present article of clothing, depicting a pocket 6 disposed on the internal surface of the front sheet of the article of clothing, inside pockets 20 disposed at sleeves and pockets 32 that are disposed within a hood 38 and the openings of the pocket of the front sheet closeable each with a zipper 40. A pocket 6 is disposed on the inner surface of the front sheet of the outer body 10. FIG. 13 depicts an article of clothing that is similar to the embodiment shown in FIG. 12 except at least one of the pockets 20 at the sleeves 4 is shown additionally with a pocket 36 for holding a heat pack where the pocket 36 is disposed within a pocket 20. FIG. 14 depicts an article of clothing that is similar to the embodiment shown in FIG. 12 except at least one of the inside pockets on the sleeve is void of an internal pocket for holding a heat pack and the pocket of the front sheet is void of zipper-controlled accesses. FIG. 15 depicts an article of clothing that is similar to the embodiment shown in FIG. 12 except the article of clothing is void of a pocket disposed on the front sheet. FIG. 16 depicts an article of clothing that is similar to the embodiment shown in FIG. 12 except the article of clothing is void of a hood. FIG. 17 depicts an article of clothing that is similar to the embodiment shown in FIG. 12 except the hood is void of pockets disposed therein. FIG. 18 depicts an article of clothing that is similar to the embodiment shown in FIG. 12 except the hood is void of pockets disposed therein and the access to the openings of pocket of the front sheet is not zipper-controlled. FIG. 19 depicts an article of clothing that is similar to the embodiment shown in FIG. 12 except the sleeves are void of pockets disposed therein. FIG. 20 depicts an article of clothing that is similar to the embodiment shown in FIG. 12 except the sleeves are void of pockets disposed therein and the pocket of the front sheet is void of zipper-controlled accesses.

Figure 21:
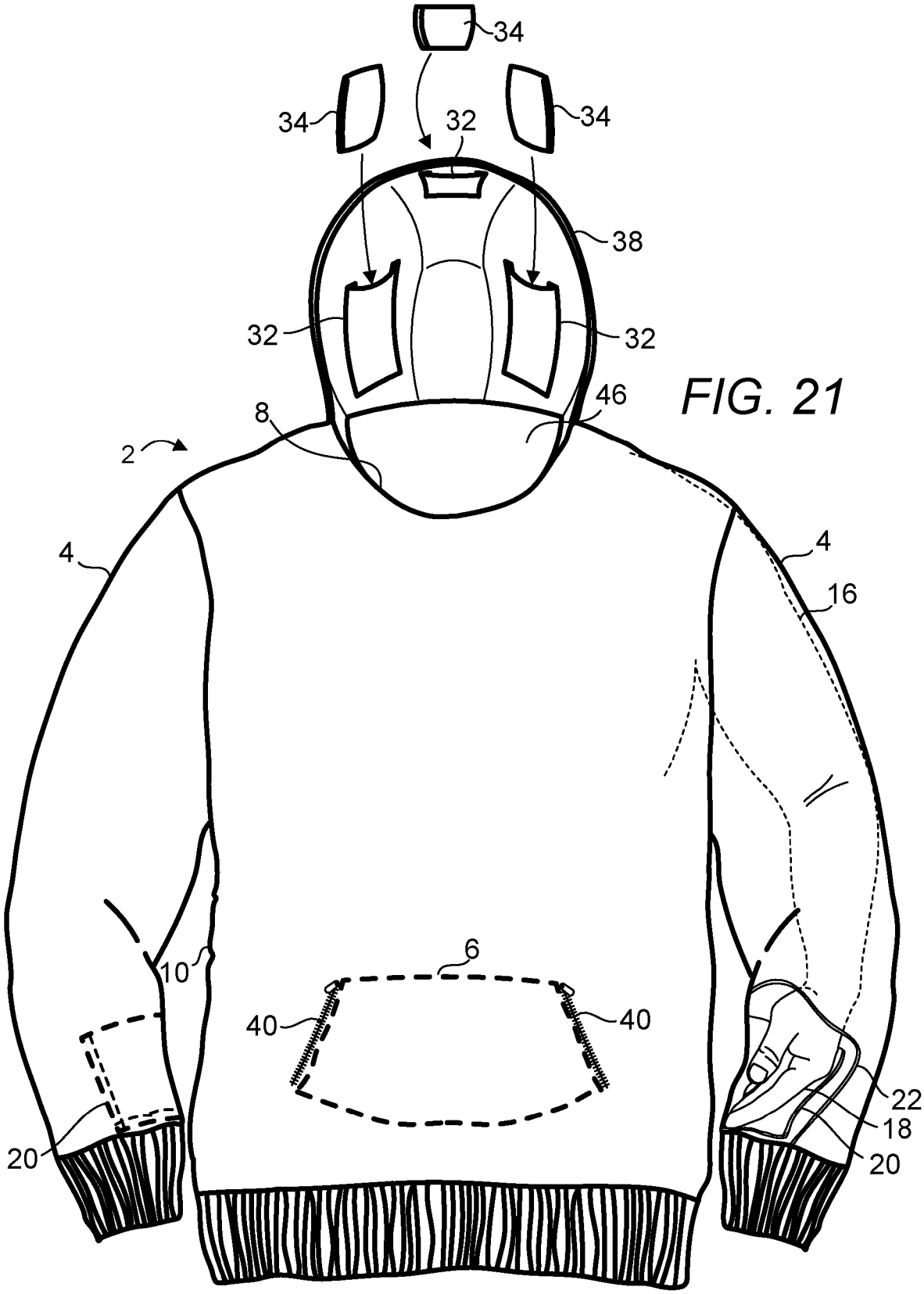
FIG. 21 depicts an article of clothing that is similar to the embodiment shown in FIG. 12 except there is further provided a pocket disposed within the hood on a surface of the ceiling of the hood.
Figure 22:
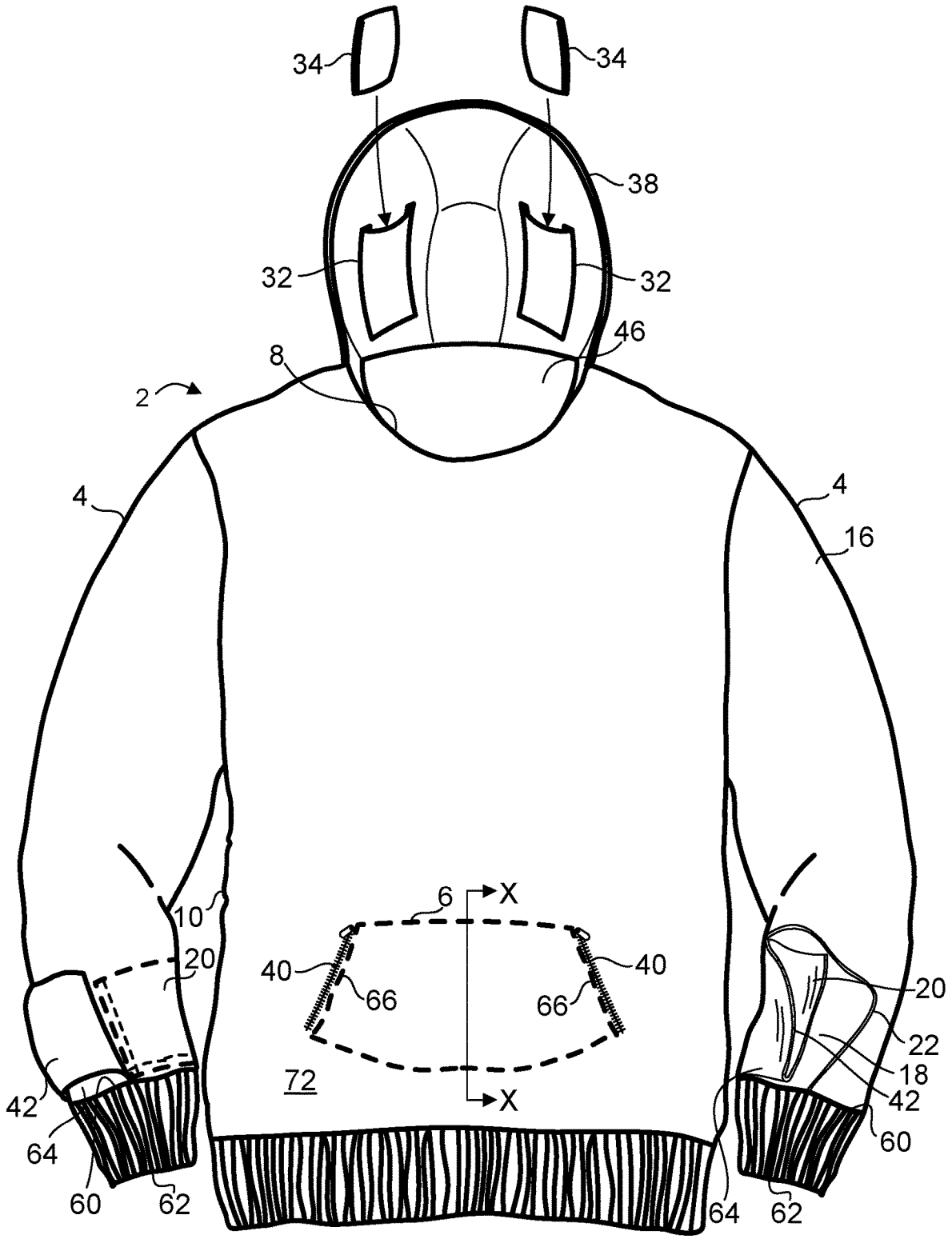
FIG. 22 depicts an article of clothing that is similar to the embodiment shown in FIG. 12 except there is further provided a first sleeve pocket that is disposed on an outside surface of a first sleeve with an opening configured for insertion of a hand put through a second sleeve and a second sleeve pocket that is disposed on an inside surface of a second sleeve with an opening configured for insertion of a hand put through the first sleeve.
Figure 22A:
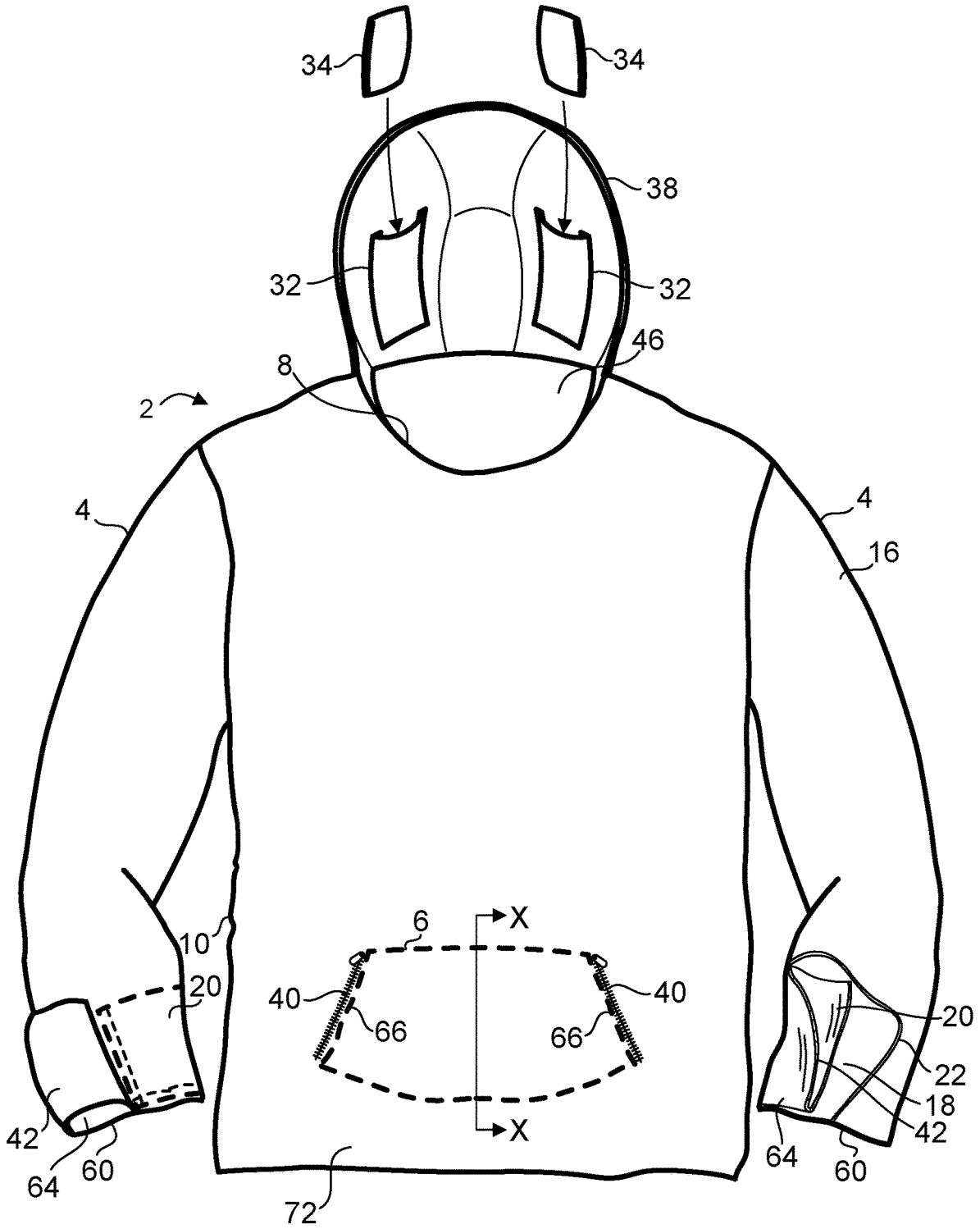
FIG. 22A depicts an article of clothing that is similar to the embodiment shown in FIG. 22 except the article of clothing includes sleeves which are not terminated with cuffs.
Figure 22B:
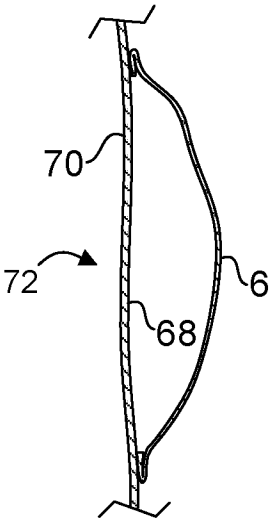
FIG. 22B is a partial close-up cross-sectional view of the pocket attached to the front sheet as taken along line X-X of FIGS. 22 and 22A.

FIG. 21 depicts an article of clothing that is similar to the embodiment shown in FIG. 12 except there is further provided a pocket disposed within the hood on a surface of the ceiling of the hood 38 where the additional pocket 32 is configured to hold a heat pack to further provide warmth on the top portion of the hood 38 to a wearer's head. FIG. 22 depicts an article of clothing that is similar to the embodiment shown in FIG. 12 except there is further provided a first sleeve pocket 42 that is disposed on an outside surface of a first sleeve with an opening configured for insertion of a hand put through a second sleeve and a second sleeve pocket 42 that is disposed on an inside surface of a second sleeve with an opening configured for insertion of a hand 18 put through the first sleeve. FIG. 22A depicts an article of clothing that is similar to the embodiment shown in FIG. 22 except the article of clothing includes sleeves which are not terminated with cuffs 62. Note that, with a cuffed sleeve 4 as shown in FIG. 22, a cuff 62 extends from the bottom edge 60 of the sleeve 4. FIG. 22B is a partial close-up cross-sectional view of the pocket attached to the front sheet as taken along line X-X of FIG. 22 or FIG. 22A. It shall be noted that the pocket 6 is attached to the innermost surface 68 of the front sheet 72 where the pocket 6 is accessible via at least one of the two openings 66 on the same surface 68.

Figure 23:
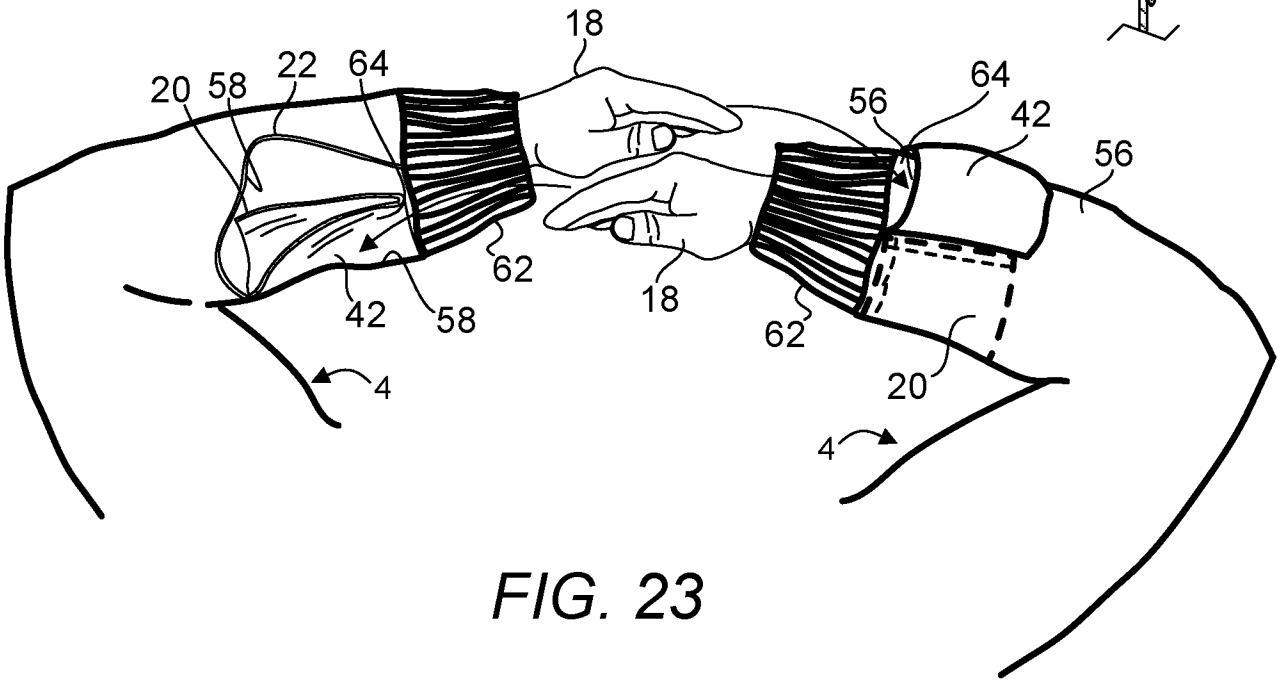
FIG. 23 is a top partial transparent view of a pair of sleeves, depicting the manner in which the first and second sleeve pockets of FIG. 22 may be used.
Figure 23A:
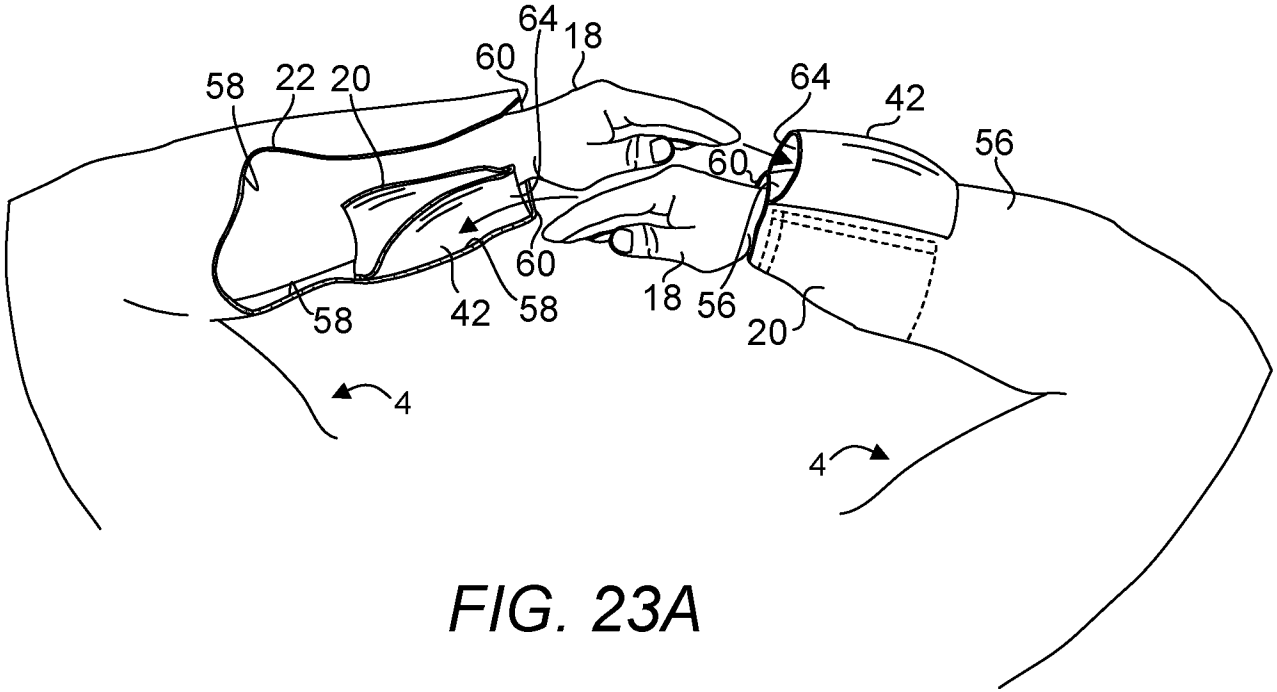
FIG. 23A is a top partial transparent view of a pair of sleeves, depicting a manner in which first and second sleeve pockets each attached to a sleeve, may be used.
Figure 23B:
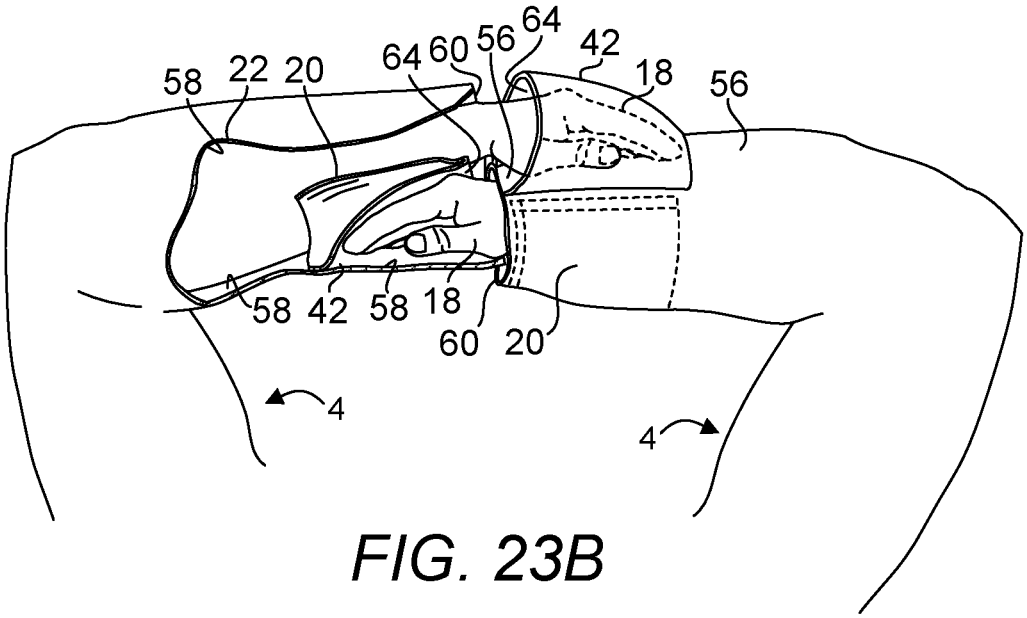
FIG. 23B is a diagram depicting a user's hands having been placed in the first and second sleeve pockets shown in FIG. 23A.
Figure 24:
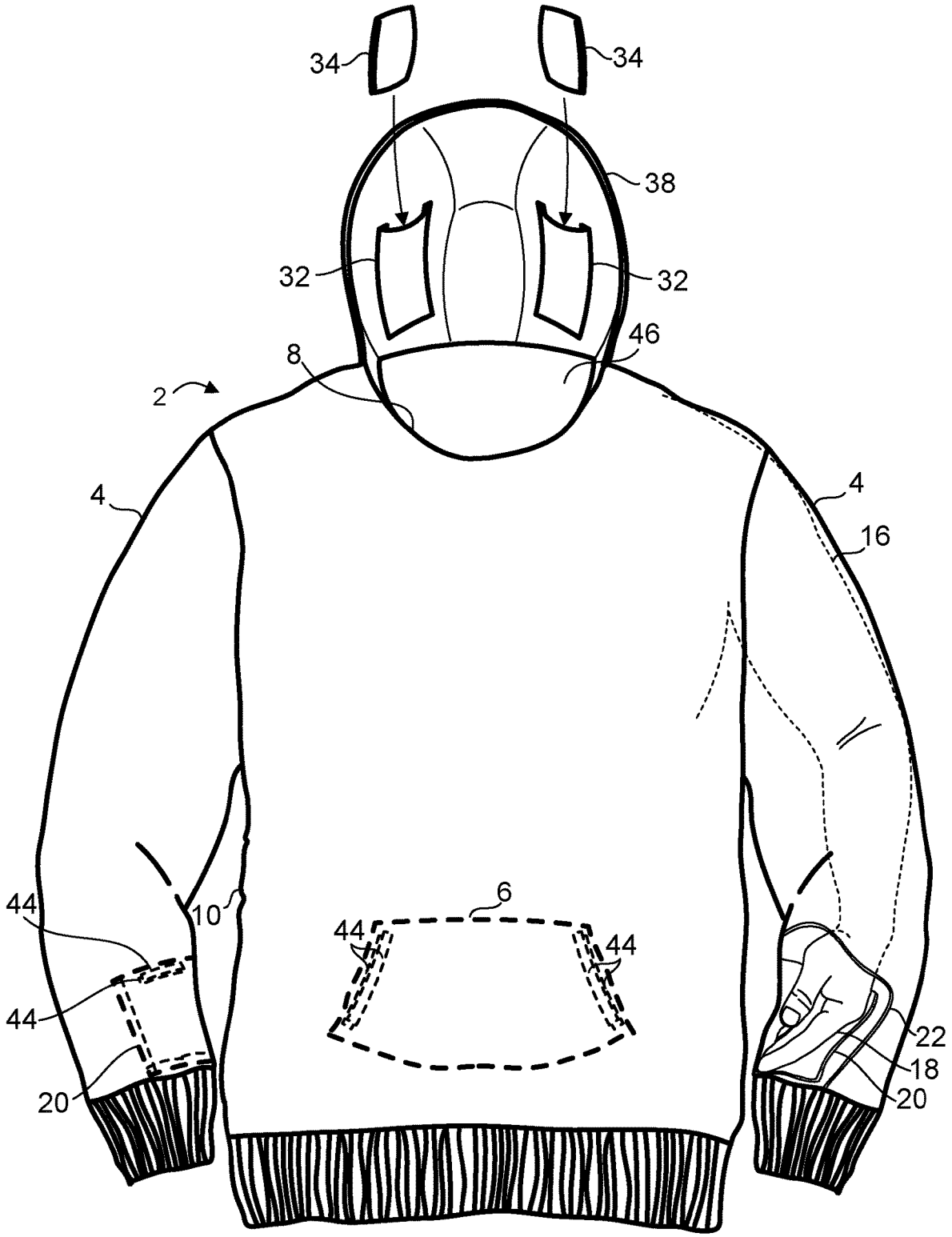
FIG. 24 depicts an article of clothing that is similar to the embodiment shown in FIG. 12 except one of the sleeve pockets is now shown with a means of closure and the pocket disposed on the front sheet with a means of closure that does not involve a zipper.

FIG. 23 is a top partial transparent view of a pair of sleeves, depicting the manner in which the first and second sleeve pockets 42 of FIG. 22 may be used. FIG. 23A is a top partial transparent view of a pair of sleeves, depicting a manner in which first and second sleeve pockets each attached to a sleeve, may be used. FIG. 23B is a diagram depicting a user's hands having been placed in the first and second sleeve pockets shown in FIG. 23A. Note that a first pocket 42 disposed at a location away from the torso of a wearer (e.g., on an outside portion of a forearm) on a first sleeve should be matched with a second pocket 42 disposed at a location closer to the torso of the wearer (e.g., on an inside portion of another forearm) on a second sleeve. It shall be noted the first pocket 42 is disposed on an outside surface 56 of the right-hand sleeve 4 while the second pocket 42 is disposed on an inside surface 58 of the left-hand sleeve 4. It shall also be noted that the opening 64 of each pocket 42 is unclosable and each pocket 42 is disposed substantially on the bottom edge 60 of a sleeve 4 and in an orientation for receiving a hand disposed through the opposing sleeve 4. In other words, the opening 64 of each pocket 42 is ready to receive a hand at any time and it is not configured to be closed with a closure means, e.g., a flap or a zipper, etc. Although not shown, a matching pair of sleeve pockets 42 can alternatively or additionally be disposed on the sleeves such that the right hand 18 can be inserted in a pocket 42 disposed on the outside of the left sleeve and a left hand 18 can be inserted in a pocket 42 disposed on the inside of the right sleeve for warmth. FIG. 24 depicts an article of clothing that is similar to the embodiment shown in FIG. 12 except one of the sleeve pockets is now shown with several means of closure 44, e.g., hook and loop systems, are provided. The closure means serves at least two purposes. First, an item, e.g., money, keys, etc., can be securely stored in a pocket armed with such closure means 44. Then, for a wearer not desiring to use a sleeve pocket, the wearer can avoid accidentally putting his or her hand in the sleeve pocket.

The article of clothing of any one of the embodiments disclosed elsewhere herein can be a sweater, T-shirt, compression fit shirt and the like. Applicant discovered that when a sweater is used, the inner body is preferably a size smaller than the outer body to facilitate putting on both sets of sleeves, retracting the inner sleeves from the outer sleeves, re-inserting the inner sleeves into the outer sleeves, inserting or removing the wearer's hands in the pocket and removing both the inner and outer bodies. However, when a T-shirt or compression fit shirt is used, the inner and outer bodies are preferably made from shirts of the same size as the materials used in the construction of a shirt is less substantial than the materials used for the construction of a sweater and presents no significant hindrance to such uses.

Figure 25:
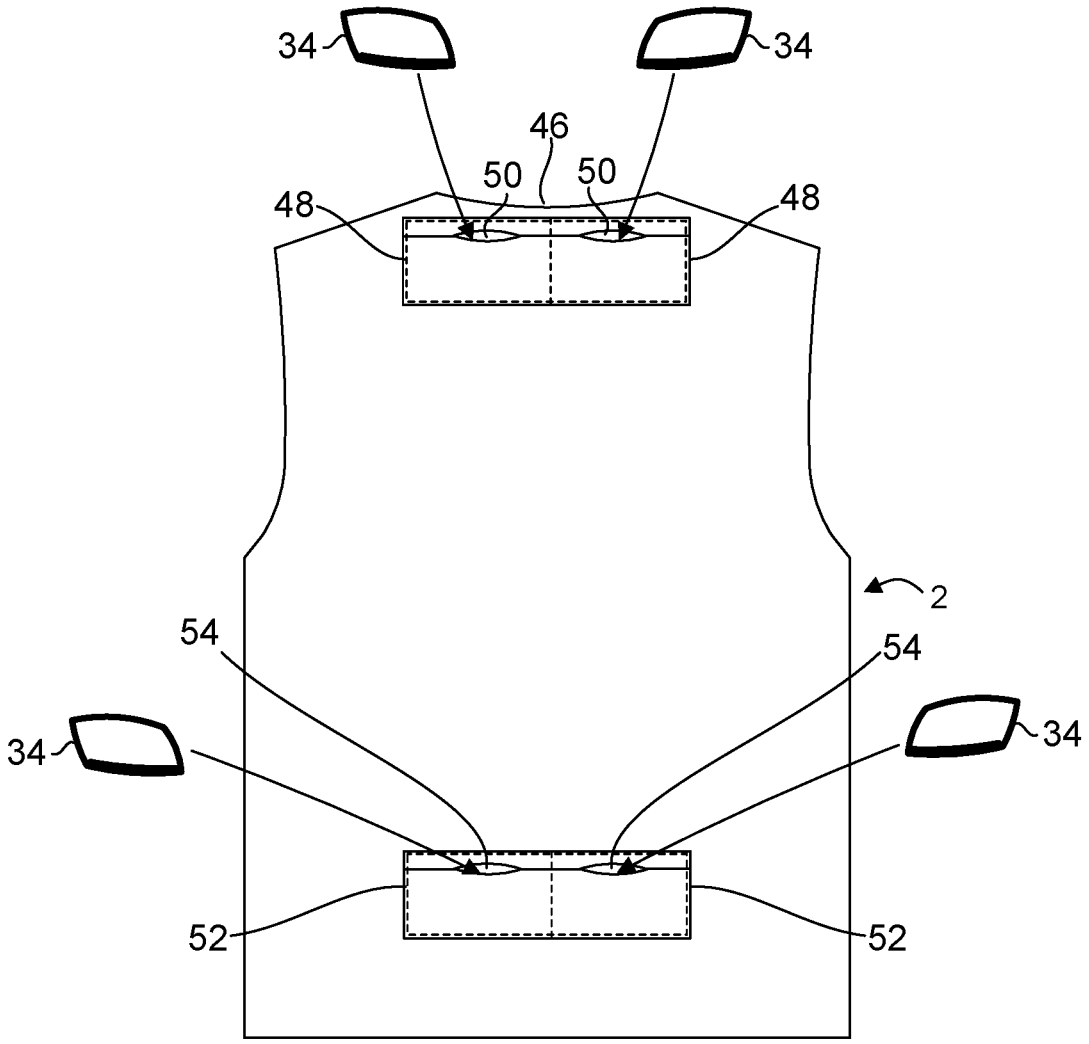
FIG. 25 depicts one embodiment of the rear sheet of a present article of clothing.
Figure 26:
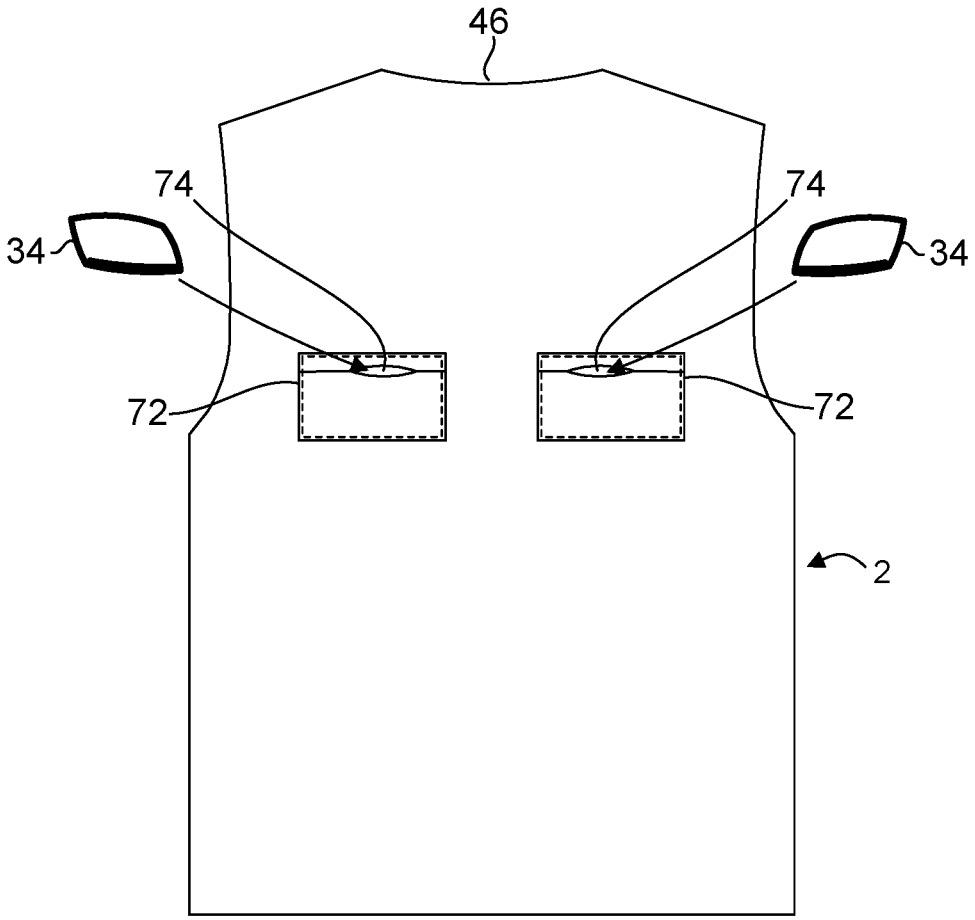
FIG. 26 depicts one embodiment of the front sheet of a present article of clothing.

FIG. 25 depicts one embodiment of the rear sheet of a present article of clothing. FIG. 26 depicts one embodiment of the rear sheet of a present article of clothing. Although a sleeveless shirt is shown in each, it shall be understood that the pockets 48, 52, 72 may be applied to any article of clothing, e.g., a sweater, etc., as long as the article of clothing has a body having a rear sheet on which pockets 48, 52 may be disposed or a front sheet on which pockets 72 may be disposed. The nape pockets 48 are disposed at a location on a rear sheet to coincide with the nape area of a user and the lower back pockets 52 are disposed at a location on the same sheet to coincide with the lower back area of the user while the user dons the article of clothing. Each pocket 48, 52 is configured to receive a heat pack 34 to create warmth and comfort for the user and to promote circulation of blood in the specific areas with heat. The breast pockets 72 are disposed at a location on a front sheet to coincide with the breast area of a user who suffers from breast cancer or breast hematomas while the user dons the article of clothing. Each breast pocket 72 is configured to receive a heat pack 34 to create warmth and comfort for the user, to relieve pain and to promote circulation of blood under and around the breast area with heat.

The detailed description refers to the accompanying drawings that show, by way of illustration, specific aspects and embodiments in which the present disclosed embodiments may be practiced. These embodiments are described in sufficient detail to enable those skilled in the art to practice aspects of the present invention. Other embodiments may be utilized, and changes may be made without departing from the scope of the disclosed embodiments. The various embodiments can be combined with one or more other embodiments to form new embodiments. The detailed description is, therefore, not to be taken in a limiting sense, and the scope of the present invention is defined only by the appended claims, with the full scope of equivalents to which they may be entitled. It will be appreciated by those of ordinary skill in the art that any arrangement that is calculated to achieve the same purpose may be substituted for the specific embodiments shown. This application is intended to cover any adaptations or variations of embodiments of the present invention. It is to be understood that the above description is intended to be illustrative, and not restrictive, and that the phraseology or terminology employed herein is for the purpose of description and not of limitation. Combinations of the above embodiments and other embodiments will be apparent to those of skill in the art upon studying the above description. The scope of the present disclosed embodiments includes any other applications in which embodiments of the above structures and fabrication methods are used. The scope of the embodiments should be determined with reference to the appended claims, along with the full scope of equivalents to which such claims are entitled.

What is claimed herein is:

1. An article of clothing adapted for use by a wearer having a torso having a front side, said article of clothing comprising:

(a) a body configured for covering the torso, said body comprising a single front sheet configured for covering the front side of the torso of the wearer, said single front sheet having an innermost surface and a first pocket disposed on said innermost surface of said single front sheet, wherein said first pocket comprises two openings, each opening adapted for access with one hand of the wearer;

(b) said article of clothing further comprises a first sleeve and a second sleeve each having a top end, a bottom end, an inside surface and an outside surface, each of said first sleeve and second sleeves is attached at said top end to said body and the sleeves comprising a pair of second pockets where a first pocket of said pair of the second pockets is disposed on said bottom end of said inside surface of said first sleeve, and a second of said pair of second pockets is disposed on said bottom end of said inside surface of said second sleeve, said pair of second pockets each having an opening facing side top end of each of the first and second sleeves;

(c) a neck opening disposed on a top portion of said body and a hood extending from said neck opening, said hood comprising a pair of third pockets, each of said pair of third pockets of said hood is configured for receiving a heat pack and each of said pair of third pockets is disposed at a location such that when disposed over the wearer, said each of said pair of third pockets is disposed substantially over an ear of the wearer; and (d) a pair of fourth pockets, a first of said pair of fourth pockets is disposed on said bottom end on said outside surface of said first sleeve with an unclosable opening of said first of said pair of fourth pockets disposed on a bottom edge of said first sleeve and a second of said pair of fourth pockets is disposed on said bottom end on said inside surface of the second sleeve and having an unclosable opening disposed on a bottom edge of the second sleeve, wherein said second pocket of said pair of second pockets is disposed directly on top of said second pocket of said pair of fourth pockets.

2. The article of clothing of claim 1 is a sweater.

3. The article of clothing of claim 1, said first pocket of said pair of second pockets further comprises an internal pocket attached to a portion of an interior surface of said first pocket of said pair of second pockets, said internal pocket comprises an opening configured for receiving a heat pack.

4. The article of clothing of claim 1, wherein at least one of said two openings of said first pocket comprises a zipper configured for controlling access through said at least one opening of said first pocket.

5. The article of clothing of claim 1, wherein said at least one opening of said first pocket of said pair of second pockets comprises a complementary hook and loop system configured for controlling access through said at least one opening of said first pocket of said pair of second pockets.

6. The article of clothing of claim 1, further comprising a ceiling pocket configured for holding a heat pack, said ceiling pocket is disposed on a surface of a ceiling of the hood.

7. The article of clothing of claim 1, further comprising a cuff extending from said bottom edge of at least one of said first sleeve and said second sleeve.

8. An article of clothing adapted for use by a wearer having a torso having a front side, said article of clothing comprising:

(a) a body configured for covering the torso, said body comprising a single front sheet configured for covering the front side of the torso of the wearer, said single front sheet having an innermost surface and a first pocket disposed on said innermost surface of said single front sheet, wherein said first pocket comprises two openings, each opening adapted for access with one hand of the wearer;

(b) said article of clothing further comprises a first sleeve and a second sleeve each having a top end, a bottom end, an inside surface and an outside surface, each of said first sleeve and second sleeves is attached at said top end to said body and the sleeves comprising a pair of second pockets where a first pocket of said pair of the second pockets is disposed on said bottom end of said inside surface of said first sleeve, and a second of said pair of second pockets is disposed on said bottom end of said inside surface of said second sleeve, said pair of second pockets each having an opening facing side top end of each of the first and second sleeves;

(c) a neck opening disposed on a top portion of said body and a hood extending from said neck opening, said hood comprising a pair of third pockets, each of said pair of third pockets of said hood is configured for receiving a heat pack and each of said pair of third pockets is disposed at a location such that when disposed over the wearer, said each of said pair of third pockets is disposed substantially over an ear of the wearer;

(d) a cuff extending from said bottom edge of at least one of said first sleeve and said second sleeve; and (e) a pair of fourth pockets, a first of said pair of fourth pockets is disposed on said bottom end on said outside surface of said first sleeve with an unclosable opening of said first of said pair of fourth pockets disposed on a bottom edge of said first sleeve and a second of said pair of fourth pockets is disposed on said bottom end on said inside surface of the second sleeve located directly on top of the second pocket of said pair of second pockets and having an unclosable opening disposed on a bottom edge of the second sleeve, wherein said second pocket of said pair of second pockets is disposed directly on top of said second pocket of said pair of fourth pockets.

9. The article of clothing of claim 1 is a sweater.

10. The article of clothing of claim 1, said first pocket of said pair of second pockets further comprises an internal pocket attached to a portion of an interior surface of said first pocket of said pair of second pockets, said internal pocket comprises an opening configured for receiving a heat pack.

11. The article of clothing of claim 1, wherein at least one of said two openings of said first pocket comprises a zipper configured for controlling access through said at least one opening of said first pocket.

12. The article of clothing of claim 1, wherein said at least one opening of said first pocket of said pair of second pockets comprises a complementary hook and loop system configured for controlling access through said at least one opening of said first pocket of said pair of second pockets.

13. The article of clothing of claim 1, further comprising a ceiling pocket configured for holding a heat pack, said ceiling pocket is disposed on a surface of a ceiling of the hood.

* * * * *